US010584722B2

(12) United States Patent
Hijikata et al.

(10) Patent No.: US 10,584,722 B2
(45) Date of Patent: Mar. 10, 2020

(54) HYDRAULIC FLUID ENERGY REGENERATION APPARATUS OF WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Takatoshi Ooki, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 221 days.

(21) Appl. No.: 15/555,281

(22) PCT Filed: Sep. 29, 2015

(86) PCT No.: PCT/JP2015/077593
§ 371 (c)(1),
(2) Date: Sep. 1, 2017

(87) PCT Pub. No.: WO2017/056200
PCT Pub. Date: Apr. 6, 2017

(65) Prior Publication Data
US 2018/0051720 A1 Feb. 22, 2018

(51) Int. Cl.
*F15B 11/024* (2006.01)
*E02F 9/22* (2006.01)
(Continued)

(52) U.S. Cl.
CPC ..... *F15B 11/024* (2013.01); *E02F 9/2217* (2013.01); *E02F 9/2221* (2013.01);
(Continued)

(58) Field of Classification Search
CPC ..... F15B 11/17; F15B 11/165; F15B 11/024; E02F 9/2217; E02F 9/2221; E02F 9/2242
(Continued)

(56) References Cited

U.S. PATENT DOCUMENTS 6,050,090 A * 4/2000 Tohji ..... E02F 9/2203 60/421
6,148,548 A * 11/2000 Tohji ..... E02F 9/2242 37/348

(Continued)

FOREIGN PATENT DOCUMENTS

CN 104024659 A 9/2014
CN 106030123 A 10/2016

(Continued)

OTHER PUBLICATIONS

International Search Report (PCT/ISA/210) issued in PCT Application No. PCT/JP2015/077593 dated Dec. 22, 2015 with English translation (5 pages).

(Continued)

*Primary Examiner* — Nathaniel E Wiehe
*Assistant Examiner* — Richard C Drake
(74) *Attorney, Agent, or Firm* — Crowell & Moring LLP

(57) ABSTRACT

A hydraulic fluid energy regeneration apparatus of a work machine includes: a regeneration hydraulic motor driven by a return hydraulic fluid; a first hydraulic pump mechanically connected to the regeneration hydraulic motor; a second hydraulic pump that delivers a hydraulic fluid for driving a hydraulic actuator; a confluence line that causes the hydraulic fluid delivered from the first hydraulic pump to join the hydraulic fluid delivered from the second hydraulic pump; a first adjuster configured to adjust the flow rate of the hydraulic fluid of the first hydraulic pump; and a second adjuster configured to adjust the delivery flow rate of the
(Continued)

second hydraulic pump. A control device includes: a first calculation section configured to calculate a non-confluence time pump flow rate in the case where the hydraulic actuator is driven solely by the second hydraulic pump and calculate a control command output to the first adjuster such that the flow rate of the hydraulic fluid from the first hydraulic pump is equal to or lower than the non-confluence time pump flow rate; and a second calculation section configured to calculate a target pump flow rate by subtracting from the non-confluence time pump flow rate the flow rate of the hydraulic fluid from the first hydraulic pump and calculate a control command output to the second adjuster such that the target pump flow rate is attained.

11 Claims, 16 Drawing Sheets

(51) Int. Cl.
*F15B 11/042* (2006.01)
*F15B 11/16* (2006.01)
*F15B 11/17* (2006.01)

(52) U.S. Cl.
CPC ..... *E02F 9/2242* (2013.01); *F15B 11/0423* (2013.01); *F15B 11/165* (2013.01); *F15B 11/17* (2013.01); *F15B 2211/20507* (2013.01); *F15B 2211/20576* (2013.01); *F15B 2211/3133* (2013.01); *F15B 2211/40515* (2013.01); *F15B 2211/41527* (2013.01); *F15B 2211/426* (2013.01); *F15B 2211/6309* (2013.01); *F15B 2211/6313* (2013.01); *F15B 2211/6316* (2013.01); *F15B 2211/665* (2013.01); *F15B 2211/6652* (2013.01); *F15B 2211/6654* (2013.01); *F15B 2211/761* (2013.01)

(58) Field of Classification Search
USPC ..... 60/413
See application file for complete search history.

(56) References Cited

U.S. PATENT DOCUMENTS 6,378,303 B1 * 4/2002 Higuchi ..... E02F 9/2235 60/468
6,460,332 B1 * 10/2002 Maruta ..... E02F 9/2075 60/414
7,770,697 B2 * 8/2010 Futahashi ..... B66F 9/22 187/224
8,510,000 B2 * 8/2013 Kawasaki ..... E02F 9/2075 180/275
8,606,452 B2 * 12/2013 Kawasaki ..... E02F 9/2075 701/22
8,659,177 B2 * 2/2014 Fujishima ..... E02F 9/2217 290/1 R
9,803,339 B2 * 10/2017 Nanjo ..... E02F 9/226
10,161,108 B2 * 12/2018 Hijikata ..... E02F 9/2075
10,179,987 B2 * 1/2019 Kawasaki ..... F15B 21/14
10,221,871 B2 * 3/2019 Imura ..... E02F 9/123
2014/0283509 A1 9/2014 Hijikata
2015/0007557 A1 * 1/2015 Egawa ..... F15B 21/14 60/446
2015/0176609 A1 * 6/2015 Kawasaki ..... F15B 21/14 60/448
2015/0184364 A1 * 7/2015 Kawasaki ..... F15B 21/14 701/50
2017/0009428 A1 * 1/2017 Hijikata ..... F15B 21/14

FOREIGN PATENT DOCUMENTS

JP 2000-136806 A 5/2000
JP 2013-200023 A 10/2013
JP 2014-34827 A 2/2014
KR 10-2015-0016283 A 2/2015
WO WO 2013/099710 A1 7/2013

OTHER PUBLICATIONS

Japanese-language Written Opinion (PCT/ISA/237) issued in PCT Application No. PCT/JP2015/077593 dated Dec. 22, 2015 (3 pages).
International Preliminary Report on Patentability (PCT/IB/338 & PCT/IB/373) issued in PCT Application No. PCT/JP2015/077593 dated Apr. 12, 2018, including English translation of document C2 (Japanese-language Written Opinion (PCT/ISA/237)) previously filed on Sep. 1, 2017 (five pages).
Korean-language Office Action issued in counterpart Korean Application No. 10-2017-7022040 dated Oct. 12, 2018 with English translation (10 pages).
Chinese-language Office Action issued in counterpart Chinese Application No. 201580075749.5 dated Mar. 15, 2018 (six pages).

* cited by examiner

HYDRAULIC FLUID ENERGY REGENERATION APPARATUS OF WORK MACHINE

TECHNICAL FIELD

The present invention relates to a hydraulic fluid energy regeneration apparatus of a work machine and, more specifically, to a hydraulic fluid energy regeneration apparatus of a work machine equipped with a hydraulic actuator, such as a hydraulic excavator.

BACKGROUND ART

Regarding a work machine, in order to make it possible for arranging in a limited space without occupying a large space, and to provide a hydraulic fluid energy recovery apparatus and a hydraulic fluid energy recovery/regeneration apparatus capable of expanding the range of use of the recovered energy, there exists an apparatus equipped with a hydraulic pump motor driven by return hydraulic fluid from a hydraulic actuator, an electric motor that generates power with the drive force of the hydraulic pump motor, and a battery that stores the electric power generated by the electric motor (see, for example, Patent Document 1).

PRIOR ART DOCUMENT

Patent Document

Patent Document 1: JP-2000-136806-A

SUMMARY OF THE INVENTION

Problem to be Solved by the Invention

According to the above-mentioned prior-art technique, the energy of the hydraulic fluid is stored in a battery as electrical energy, so that, as compared with the case where the energy of the hydraulic fluid is stored in an accumulator or the like, no large space is advantageously required.

In the case of the work machine of the prior-art technique, however, the energy of the hydraulic fluid is once converted to electrical energy to be stored in the battery, so that the loss at the time of recovery and use is rather large, which results in the problem of the impossibility of effectively utilizing the energy.

That is, when storing the energy of the return hydraulic fluid of the hydraulic actuator in the battery, there are generated the loss in the hydraulic pump motor, the loss in the electric motor, and the charging/discharging loss of the battery, so that energy in an amount obtained through subtraction of the sum total of these losses is stored in the battery. Further, also when utilizing the energy stored in the battery, the loss in the battery, the electric motor, and the hydraulic pump motor is generated. Thus, taking into account the loss from the recovery to the utilization, in the work machine to which the prior-art technique is applied, there may be a case where approximately half the energy that could be recovered and utilized is lost as a loss.

The present invention has been made in view of the above circumstances. It is an object of the present invention to provide a hydraulic fluid energy regeneration apparatus of a work machine capable of efficiently utilizing a return hydraulic fluid from a hydraulic actuator.

Means for Solving the Problem

To achieve the above object, according to a first aspect of the invention, there is provided a hydraulic fluid energy regeneration apparatus of a work machine including: a first hydraulic actuator; a regeneration hydraulic motor driven by a return hydraulic fluid discharged from the first hydraulic actuator; a first hydraulic pump mechanically connected to the regeneration hydraulic motor; a second hydraulic pump that delivers a hydraulic fluid for driving at least one of the first hydraulic actuator and a second hydraulic actuator; a confluence line that causes the hydraulic fluid delivered from the first hydraulic pump to join the hydraulic fluid delivered from the second hydraulic pump; a first adjuster configured to adjust a flow rate of the hydraulic fluid from the first hydraulic pump flowing through the confluence line; a second adjuster configured to adjust a delivery flow rate of the second hydraulic pump; and a control device configured to output respective control commands to the first adjuster and the second adjuster. The control device includes a first calculation section configured to calculate a non-confluence time pump flow rate in a case where there is no confluence of the hydraulic fluid delivered from the first hydraulic pump and where at least one of the first hydraulic actuator and the second hydraulic actuator is driven solely by the second hydraulic pump and calculate a control command output to the first adjuster such that the flow rate of the hydraulic fluid from the first hydraulic pump flowing through the confluence line is lower than the non-confluence time pump flow rate, and a second calculation section configured to calculate a target pump flow rate by subtracting from the non-confluence time pump flow rate the flow rate of the hydraulic fluid from the first hydraulic pump flowing through the confluence line and calculate a control command output to the second adjuster such that the target pump flow rate is attained.

Effect of the Invention

According to the present invention, a hydraulic pump mechanically connected to a regeneration hydraulic motor can be directly driven with recovered energy, so that the loss at the time of once storing energy is not generated. As a result, the energy conversion loss can be reduced, so that it is possible to utilize energy efficiently.

MODES FOR CARRYING OUT THE INVENTION

In the following, a hydraulic fluid energy regeneration apparatus of a work machine according an embodiment of the present invention will be described with reference to the drawings.

Embodiment 1

Figure 1:
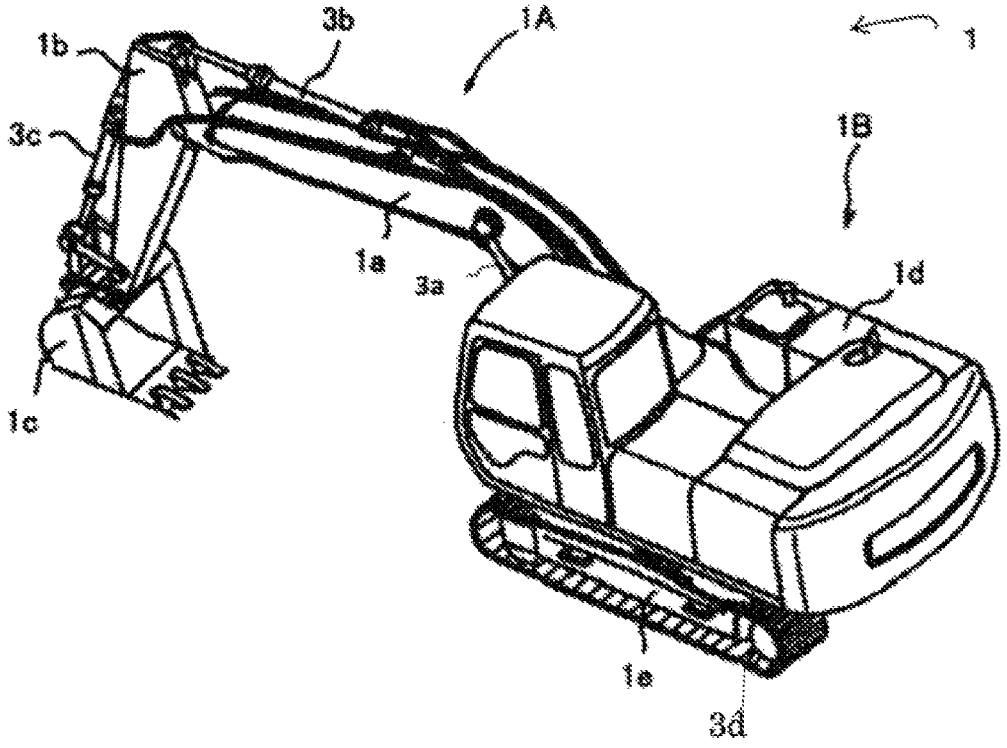
FIG. 1 is a perspective view of a hydraulic excavator equipped with a hydraulic fluid energy regeneration apparatus of a work machine according to a first embodiment of the present invention.
Figure 2:
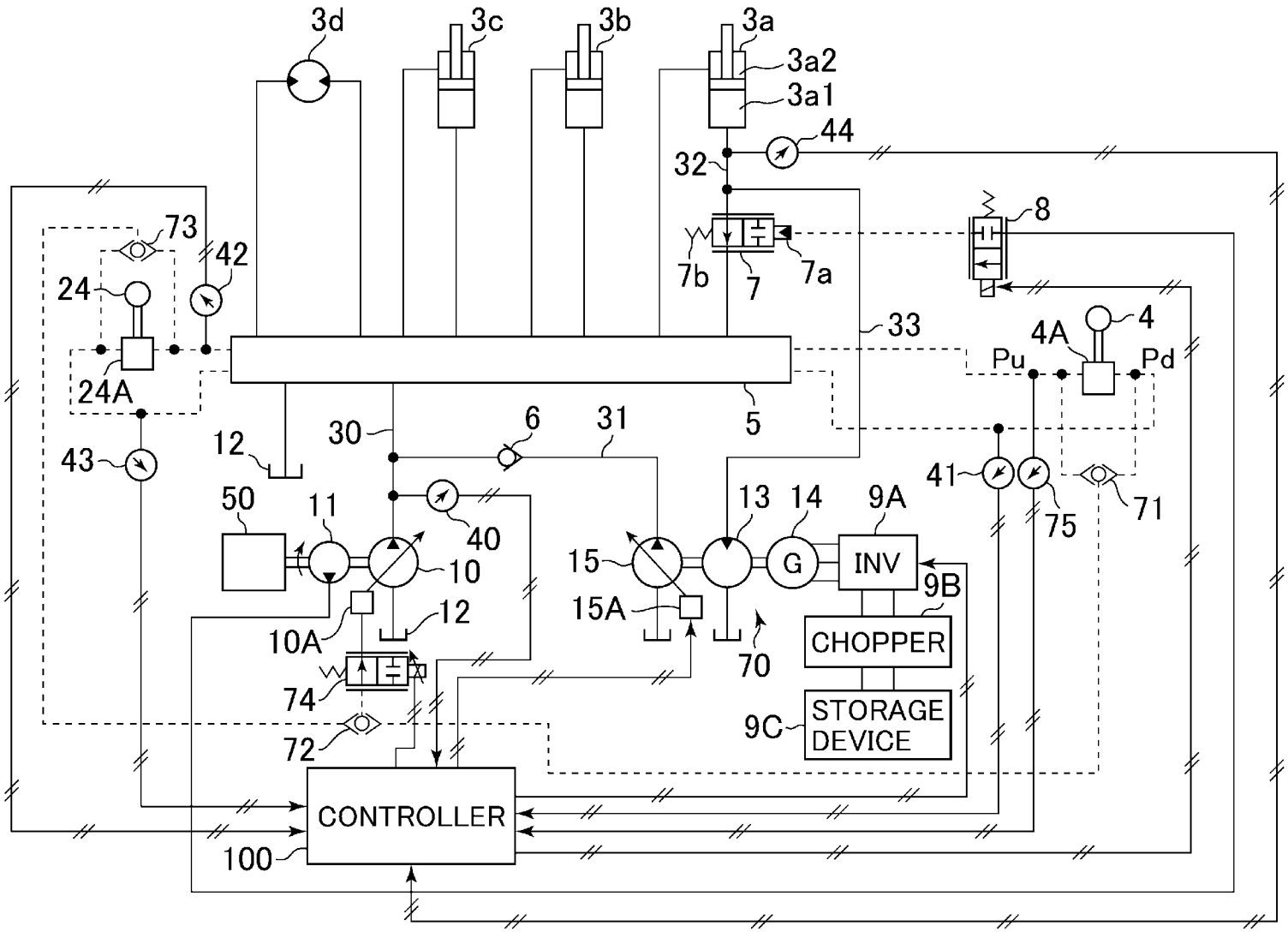
FIG. 2 is a schematic view of a drive control system, illustrating the hydraulic fluid energy regeneration apparatus of a work machine according to the first embodiment of the present invention.

FIG. 1 is a perspective view of a hydraulic excavator equipped with a hydraulic fluid energy regeneration apparatus of a work machine according to a first embodiment of the present invention, and FIG. 2 is a schematic view of a drive control system, illustrating the hydraulic fluid energy regeneration apparatus of a work machine according to the first embodiment of the present invention.

In FIG. 1, a hydraulic excavator 1 is equipped with a multiple joint type work device 1A having a boom 1*a*, an arm 1*b*, and a bucket 1*c*, and a vehicle body 1B having an upper swing structure 1*d* and a lower track structure 1*e*. The boom 1*a* is rotatably supported by the upper swing structure 1*d*, and is driven by a boom cylinder (hydraulic cylinder) 3*a* which is a first hydraulic actuator. The upper swing structure 1*d* is swingably provided on the lower track structure 1*e*.

The arm 1*b* is rotatably supported by the boom 1*a*, and is driven by an arm cylinder (hydraulic cylinder) 3*b*. The bucket 1*c* is rotatably supported by the arm 1*b*, and is driven by a bucket cylinder (hydraulic cylinder) 3*c*. The lower track structure 1*e* is driven by left and right traveling motors 3*d* and 3*e*. The driving of the boom cylinder 3*a*, the arm cylinder 3*b*, and the bucket cylinder 3*c* is controlled by operation devices 4 and 24 (see FIG. 2) that are installed in an operation room (cab) of the upper swing structure 1*d* and output respective hydraulic signals.

The drive control system shown in FIG. 2 is equipped with a power regeneration device 70, the operation devices 4 and 24, a control valve 5 consisting of a plurality of spool type directional control valves, a check valve 6, a selector valve 7, a solenoid selector valve 8, an inverter 9A as a third adjuster, a chopper 9B, and a storage device 9C, and is equipped with a controller 100 as a control device.

As hydraulic fluid source devices, there are provided a variable displacement hydraulic pump 10 as a second hydraulic pump, a pilot hydraulic pump 11 that supplies a pilot hydraulic fluid, and a tank 12. The hydraulic pump 10 and the pilot hydraulic pump 11 are driven by an engine 50 connected thereto via a drive shaft. The hydraulic pump 10 has a regulator 10A as a second adjuster, and the regulator 10A controls the swash plate tilting angle of the hydraulic pump 10 by a pilot hydraulic fluid supplied via a solenoid proportional valve 74 described below, whereby the delivery flow rate of the hydraulic pump 10 is adjusted.

In a hydraulic line 30 that supplies the hydraulic fluid from the hydraulic pump 10 to the boom cylinder 3*a*—the traveling motor 3*d*, there are provided an auxiliary hydraulic line 31 as a confluence line connected via the check valve 6 described below, the control valve 5 that consists of the plurality of spool type directional control valves and controls the direction and flow rate of the hydraulic fluid supplied to the actuators, and a pressure sensor 40 that detects the delivery pressure of the hydraulic pump 10. Through the supply of a pilot hydraulic fluid to respective pilot pressure receiving portions thereof, the control valve 5 switches the spool positions of the directional control valves, and supplies the hydraulic fluid from the hydraulic pump 10 to the hydraulic actuators to drive the arm 1*b*, etc. The pressure sensor 40 outputs the detected delivery pressure of the hydraulic pump 10 to a controller 100 described below.

The spool positions of the directional control valves of the control valve 5 are switched through the operation of the operation levers, etc. of the operation devices 4 and 24. Through the operation of the operation levers, etc., the operation devices 4 and 24 supply the pilot primary hydraulic fluid, which is supplied from the pilot hydraulic pump 11 via a pilot primary side hydraulic line (not shown), to the respective pilot pressure receiving portions of the control valve 5 via respective pilot secondary hydraulic lines. Here, the operation device 4 operates a boom cylinder 3*a*, which is a first hydraulic actuator, and the operation device 24 operates the hydraulic actuators other than the boom cylinder 3*a*, which are second hydraulic actuators. The latter is shown in a collected form.

The operation device 4 has a pilot valve 4A provided thereinside, and is connected to pressure receiving portions of a spool type directional control valve of the control valve 5 that controls the driving of the boom cylinder 3*a* via pilot piping. The pilot valve 4A outputs a hydraulic signal to the pilot pressure receiving portion of the control valve 5 in accordance with the tilting direction and operation amount of the operation lever of the operation device 4. The spool type directional control valve that controls the driving of the boom cylinder 3*a* is switched in position in accordance with a hydraulic signal input from the operation device, and controls the flow of the hydraulic fluid delivered from the hydraulic pump 10 in accordance with its switching position to thereby control the driving of the boom cylinder 3*a*. Here, a pressure sensor 75 as an operation amount sensor is mounted to pilot piping through which there passes a hydraulic signal (a boom raising operation signal Pu) for driving the boom cylinder 3*a* such that the boom 1*a* is operated in the raising direction. The pressure sensor 75 outputs the detected boom raising operation signal Pu to the controller 100 described below. Further, a pressure sensor 41 as an operation amount sensor is mounted to pilot piping through which there passes a hydraulic signal (a boom lowering operation signal Pd) for driving the boom cylinder 3*a* such that the boom 1*a* is operated in the lowering direction. The pressure sensor 41 outputs the detected boom lowering operation signal Pd to the controller 100 described below.

The operation device 24 has a pilot valve 24A thereinside, and is connected to pressure receiving portions of spool type directional control valves of the control valve 5 that controls the driving of the actuators other than the boom cylinder 3*a* via pilot piping. The pilot valve 24A outputs a hydraulic signal to the pilot pressure receiving portion of the control valve 5 in accordance with the tilting direction and operation amount of the operation lever of the operation device 24. The spool type directional control valve that controls the driving of the hydraulic actuator concerned is switched in position in accordance with a hydraulic signal input from the operation device, and controls the flow of the hydraulic fluid delivered from the hydraulic pump 10 in accordance with its switching position to thereby control the driving of the hydraulic actuator concerned.

The two systems of pilot piping connecting the pilot valve 24A of the operation device 24 and the respective pressure receiving portions of the control valve 5 are provided with pressure sensors 42 and 43 that detect the respective pilot pressures. The pressure sensors 42 and 43 output a detected operation amount signal of the operation device 24 to the controller 100 described below.

To hydraulic lines that branch off from the two systems of pilot piping connecting the pilot valve 4A of the operation device 4 and the respective pressure receiving portions of the control valve 5, there is connected input ports of a first high pressure selection valve 71 selecting a high-value hydraulic fluid of these lines. Further, to hydraulic lines that branch off from the two systems of pilot piping connecting the pilot valve 24A of the operation device 24 and the respective pressure receiving portions of the control valve 5, there is connected input ports of a second high pressure selection valve 73 selecting a high-value hydraulic fluid of these lines. To an output port of the first high pressure selection valve 71 and an output port of the second high pressure selection valve 73, there is connected input ports of a third high pressure selection valve 72 selecting a high-value hydraulic fluid of these outputs. The output port of the third high pressure selection valve 72 is connected to the input port of a solenoid proportional valve 74.

Input to the input port of the solenoid proportional valve 74 is the hydraulic fluid output from the third high pressure selection valve 72. On the other hand, input to the operation portion of the solenoid proportional valve 74 is a command signal output from the controller 100. The solenoid proportional valve 74 adjusts and pressure-reduces the highest pilot pressure input in accordance with this command signal and supplies it to the regulator 10A.

That is, due to the first high pressure selection valve 71, the second high pressure selection valve 73, and the third high pressure selection valve 72, the highest pilot pressure output from the pilot valve 24A and the pilot valve 4A is selected, and input to the solenoid proportional valve 74. The solenoid proportional valve 74 reduces the input pilot pressure to a desired pressure in accordance with the command signal from the controller 100, and outputs it to the regulator 10A of the hydraulic pump 10. The regulator 10A controls the swash plate tilting angle of the hydraulic pump 10 such that a displacement volume proportional to the input pressure is attained.

In other words, the regulator 10A, which is the second adjuster, is equipped with a pump control signal unit and a pump control signal correction unit, and the pilot pressure (pump control signal) generated in the pump control signal unit is adjusted by the pump control signal correction unit before being supplied to the regulator 10A. The pump control signal unit is equipped with the pilot valve 4A of the operation device 4 that generates the pilot pressure for controlling the displacement of the hydraulic pump 10, the pilot valve 24A of the operation device 24, the first high pressure selection valve 71, the second high pressure selection valve 73, and the third high pressure selection valve 72. The pump control signal correction unit is equipped with the solenoid proportional valve 74 that reduces the pilot pressure input upon the command signal from the controller 100.

Next, the power regeneration device 70, which is a regeneration device, will be described. The power regeneration device 70 is equipped with a bottom side hydraulic line 32, a regeneration circuit 33, the selector valve 7, the solenoid selector valve 8, the inverter 9A, the chopper 9B, the storage device 9*c*, a hydraulic motor 13 as a regeneration hydraulic motor, an electric motor 14, an auxiliary hydraulic pump 15, and the controller 100.

The bottom side hydraulic line 32 is a hydraulic line through which the hydraulic fluid (return hydraulic fluid) returning to the tank 12 flows at the time of contraction of the boom cylinder 3*a*. One end side thereof is connected to a bottom side hydraulic chamber 3*a*1 of the boom cylinder 3*a*, and the other end side thereof is connected to a connection port of the control valve 5. The bottom side hydraulic line 32 is provided with a pressure sensor 44 that detects the pressure of the bottom side hydraulic chamber 3*a*1 of the boom cylinder 3*a*, and the selector valve 7 that effects switching as to whether or not to discharge the return hydraulic fluid from the bottom side hydraulic chamber 3*a*1 of the boom cylinder 3*a* to the tank 12 via the control valve 5. The pressure sensor 44 outputs the pressure of the bottom side hydraulic chamber 3*a*1 to the controller 100 described below.

The selector valve 7 has a spring 7*b* on one end side and a pilot pressure receiving portion 7*a* on the other end side. According to whether or not the pilot hydraulic fluid is supplied to the pilot pressure receiving portion 7*a*, the spool position is switched, and the communication/interruption of the return hydraulic fluid flowing into the control valve 5 from the bottom side hydraulic chamber 3*a*1 of the boom cylinder 3*a* is controlled. Pilot hydraulic fluid is supplied to the pilot pressure receiving portion 7*a* from the pilot hydraulic pump 11 via the solenoid selector valve 8.

Hydraulic fluid output from the pilot hydraulic pump 11 is input to the input port of the solenoid selector valve 8. On the other hand, a command signal output from the controller 100 is input to the operation portion of the solenoid selector valve 8. In accordance with this command signal, the supply/interruption of the pilot hydraulic fluid supplied from the pilot hydraulic pump 11 to the pilot operation portion 7*a* of the selector valve 7 is controlled.

One end of the regeneration circuit 33 is connected to a portion between the selector valve 7 of the bottom side hydraulic line 32 and the bottom side hydraulic chamber 3*a*1 of the boom cylinder 3*a*, and the other end thereof is connected to the inlet of the hydraulic motor 13. Due to this arrangement, the return hydraulic fluid from the bottom side hydraulic chamber 3*a*1 is guided to the tank 12 via the hydraulic motor 13.

The hydraulic motor 13 as a regeneration hydraulic motor is mechanically connected to the auxiliary hydraulic pump 15. Due to the drive force of the hydraulic motor 13, the auxiliary hydraulic pump 15 rotates.

Connected to the delivery port of the auxiliary hydraulic pump 15 as the first hydraulic pump is one end side of the auxiliary hydraulic line 31, and the other end side thereof is connected to the hydraulic line 30. Provided in the auxiliary hydraulic line 31 is the check valve 6 which permits inflow of the hydraulic fluid from the auxiliary hydraulic pump 15 to the hydraulic line 30 and which prohibits inflow of the hydraulic fluid from the hydraulic line 30 to the auxiliary hydraulic pump 15 side.

The auxiliary hydraulic pump 15 has a regulator 15A as a first adjuster, and the regulator 15A controls the swash plate tilting angle of the auxiliary hydraulic pump 15 by a command from the controller 100 described below, whereby the delivery flow rate of the auxiliary hydraulic pump 15 is adjusted.

The hydraulic motor 13 is further mechanically connected to the electric motor 14, and power generation is effected by the drive force of the hydraulic motor 13. Electrically connected to the electric motor 14 is the inverter 9A for controlling the revolution speed, the chopper 9B for boosting the voltage, and the storage device 9C for storing the generated electrical energy.

The controller 100 inputs a raising side pilot pressure signal Pu of the pilot valve 4A of the operation device 4 detected by the pressure sensor 75, a lowering side pilot pressure signal Pd of the pilot valve 4A of the operation device 4 detected by the pressure sensor 41, a pilot pressure signal of the pilot valve 24A of the operation device 24 detected by the pressure sensors 42 and 43, and a pressure signal of the bottom side hydraulic chamber 3*a*1 of the boom cylinder 3*a* detected by the pressure sensor 44, performs calculation in accordance with these input values, and outputs respective control commands to the solenoid selector valve 8, the inverter 9A, the solenoid proportional valve 74, and the auxiliary hydraulic pump regulator 15A.

The solenoid selector valve 8 is switched by a command signal from the controller 100, and sends the hydraulic fluid from the pilot hydraulic pump 11 to the selector valve 7. The inverter 9A is controlled to a desired revolution speed by a signal from the controller 100, and the solenoid proportional valve 74 outputs a pressure in accordance with a command signal of the controller 100 and controls the displacement of the hydraulic pump 10. The auxiliary hydraulic pump 15 is controlled to a desired displacement by a signal from the controller 100.

Next, an outline of the operation of the hydraulic fluid energy regeneration apparatus of a work machine according to the first embodiment of the present invention will be described.

First, when the operation lever of the operation device 4 shown in FIG. 2 is operated in the boom lowering direction, the pilot pressure Pd is transmitted from the pilot valve 4A to the pilot pressure receiving portion of the control valve 5, and a spool type directional control valve of the control valve 5 that controls the driving of the boom cylinder 3*a* is switch-operated. As a result, the hydraulic fluid from the hydraulic pump 10 flows into a rod side hydraulic chamber 3*a*2 of the boom cylinder 3*a* via the control valve 5. As a result, the piston rod of the boom cylinder 3*a* performs a contracting operation. With this operation, the return hydraulic fluid discharged from the bottom side hydraulic chamber 3*a*1 of the boom cylinder 3*a* is guided to the tank 12 through the bottom side hydraulic line 32 and the selector valve 7 and the control valve 5 which are in a communicating state.

At this time, input to the controller 100 are a delivery pressure signal of the hydraulic pump 10 detected by the pressure sensor 40, a pressure signal of the bottom side hydraulic chamber 3*a*1 of the boom cylinder 3*a* detected by the pressure sensor 44, the raising side pilot pressure signal Pu of the pilot valve 4A detected by the pressure sensor 75, and the lowering side pilot pressure signal Pd of the pilot valve 4A detected by the pressure sensor 41.

In this state, when the operator operates the operation lever of the operation device 4 in the boom lowering direction in such a manner as to equal or exceed a specified value, the controller 100 outputs a switching command to the solenoid selector valve 8, a revolution speed command to the inverter 9A, a displacement command to the regulator 15A of the auxiliary hydraulic pump 15, and a control command to the solenoid proportional valve 74.

As a result, the selector valve 7 is switched to the interrupting position, and the hydraulic line to the control valve 5 is interrupted, so that the return hydraulic fluid from the bottom side hydraulic chamber 3*a*1 of the boom cylinder 3*a* flows to the regeneration circuit 33, and is then discharged to the tank 12 through the driving of the hydraulic motor 13.

The auxiliary hydraulic pump 15 rotates due to the drive force of the hydraulic motor 13. The hydraulic fluid delivered from the auxiliary hydraulic pump 15 joins the hydraulic fluid delivered from the hydraulic pump 10 via the auxiliary hydraulic line 31 and the check valve 6. The controller 100 outputs a displacement command to the regulator 15A of the auxiliary hydraulic pump 15 so as to assist the power of the hydraulic pump 10. The controller 100 outputs a control command to the solenoid proportional valve 74 so as to reduce the displacement of the hydraulic pump 10 by an amount corresponding to the flow rate of the hydraulic fluid supplied from the auxiliary hydraulic pump 15.

Of the hydraulic energy input to the hydraulic motor 13, the surplus energy that has not been consumed by the auxiliary hydraulic pump 15 is consumed by driving the electric motor 14 and effecting power generation. The electrical energy generated by the electric motor 14 is stored in the storage device 9C.

In the present embodiment, the energy of the hydraulic fluid discharged from the boom cylinder 3*a* is recovered by the hydraulic motor 13, and assists the power of the hydraulic pump 10 as the drive force of the auxiliary hydraulic pump 15. Further, the surplus power is stored in the storage device 9C via the electric motor 14. Due to this arrangement, the energy is utilized effectively, and a reduction in fuel consumption is achieved.

Figure 3:
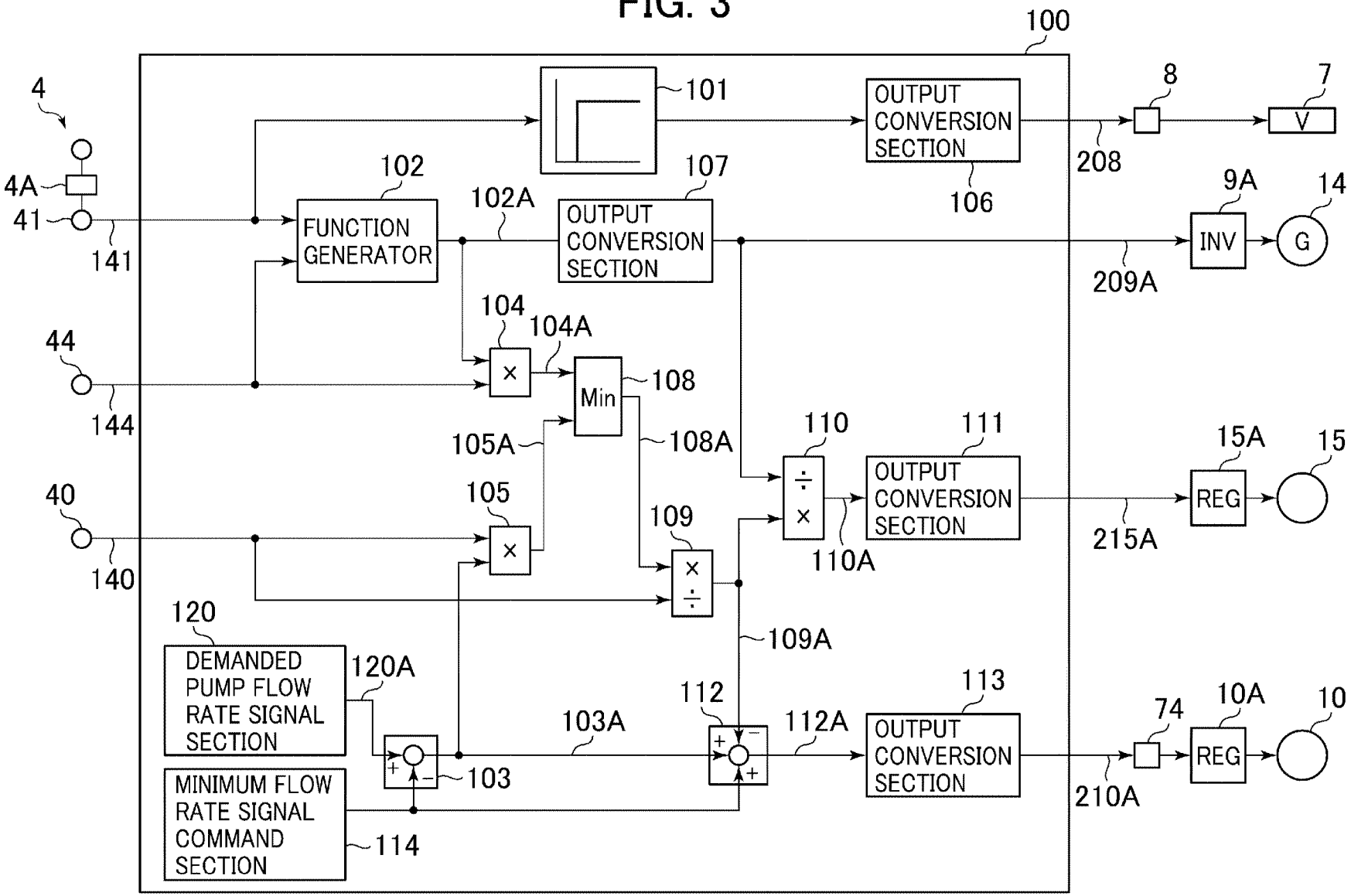
FIG. 3 is a block diagram of a controller constituting the hydraulic fluid energy regeneration apparatus of a work machine according to the first embodiment of the present invention.
Figure 4:
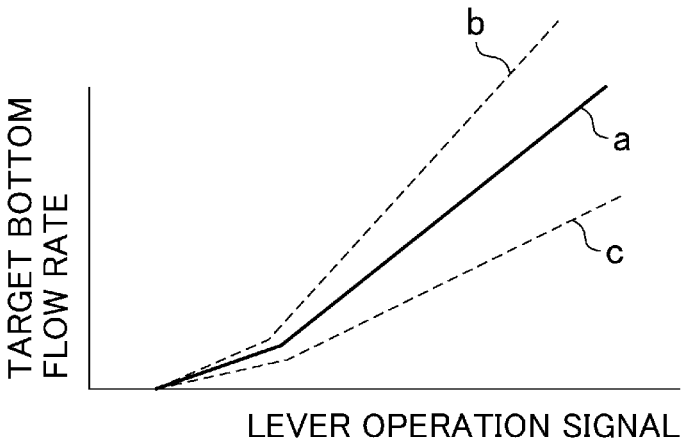
FIG. 4 is a characteristic chart illustrating the contents of a second function generator of the controller constituting the hydraulic fluid energy regeneration apparatus of a work machine according to the first embodiment of the present invention.
Figure 5:
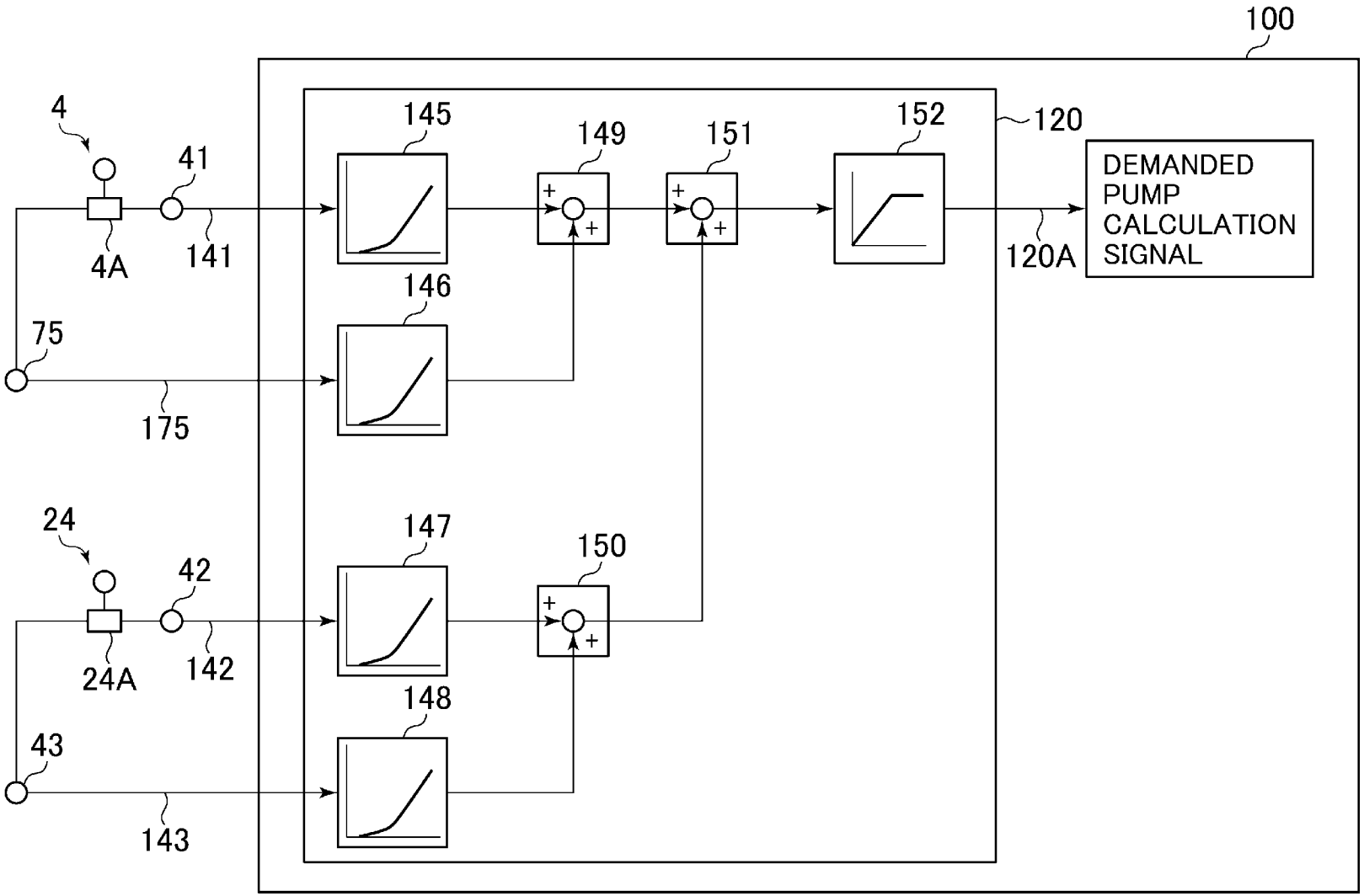
FIG. 5 is a block diagram illustrating how a hydraulic pump flow rate calculation is performed by the controller constituting the hydraulic fluid energy regeneration apparatus of a work machine according to the first embodiment of the present invention.

Next, an outline of the control by the controller 100 will be described with reference to FIGS. 3 through 5. FIG. 3 is a block diagram of the controller constituting the hydraulic fluid energy regeneration apparatus of a work machine according to the first embodiment of the present invention, FIG. 4 is a characteristic chart illustrating the contents of a second function generator of the controller constituting the hydraulic fluid energy regeneration apparatus of a work machine according to the first embodiment of the present invention, and FIG. 5 is a block diagram illustrating how a hydraulic pump flow rate calculation is performed by the controller constituting the hydraulic fluid energy regeneration apparatus of a work machine according to the first embodiment of the present invention. In FIGS. 3 through 5, the components that are the same as those of FIGS. 1 and 2 are indicated by the same reference numerals, and a detailed description thereof will be left out.

The controller 100 shown in FIG. 3 is equipped with a first function generator 101, a second function generator 102, a first subtraction calculation part 103, a first multiplication calculation part 104, a second multiplication calculation part 105, a first output conversion section 106, a second output conversion section 107, a minimum value selection calculation section 108, a first division calculation part 109, a second division calculation part 110, a third output conversion section 111, a second subtraction calculation part 112, a fourth output conversion section 113, a minimum flow rate signal command section 114, and a demanded pump flow rate signal section 120.

As shown in FIG. 3, the first function generator 101 inputs the lowering side pilot pressure Pd of the pilot valve 4A of the operation device 4 detected by the pressure sensor 41 as a lever operation signal 141. In the first function generator 101, a switching start point with respect to the lever operation signal 141 is previously stored in a table.

The first function generator 101 outputs an OFF signal when the lever operation signal 141 is the switching start point or less, and an ON signal when it exceeds the switching start point, to the first output conversion section 106. The first output conversion section 106 converts the input signal to a control signal of the solenoid selector valve 8, and outputs it to the solenoid selector valve 8 as a solenoid valve command 208. As a result, the solenoid selector valve 8 operates, the selector valve 7 is switched, and the hydraulic fluid of the bottom side hydraulic chamber 3*a*1 of the boom cylinder 3*a* flows in to the regeneration circuit 33 side.

The second function generator 102 inputs the lowering side pilot pressure Pd to one input end as the lever operation signal 141, and inputs the pressure of the bottom side hydraulic chamber 3*a*1 of the boom cylinder 3*a* detected by the pressure sensor 44 to the other input end as a pressure signal 144. Based on these input signals, the target bottom flow rate of the boom cylinder 3*a* is calculated.

The calculation of the second function generator 102 will be described in detail with reference to FIG. 4. FIG. 4 is a characteristic chart illustrating the contents of the second function generator of the controller constituting the hydraulic fluid energy regeneration apparatus of a work machine according to the first embodiment of the present invention.

In FIG. 4, the horizontal axis indicates the operation amount of the lever operation signal 141, and the vertical axis indicates a target bottom flow rate (the target flow rate of the return hydraulic fluid flowing out of the bottom side hydraulic chamber 3*a*1 of the boom cylinder 3*a*). In FIG. 4, a reference characteristic line a indicated by the solid line is set to obtain a characteristic equivalent to that of the return hydraulic fluid control by the conventional control valve 5. A characteristic line b indicated by the upper dashed line and a characteristic line c indicated by the lower dashed line indicate cases where the characteristic line a is corrected by the pressure signal 144 of the bottom side hydraulic chamber 3*a*1.

More specifically, when the pressure signal 144 of the bottom side hydraulic chamber 3*a*1 increases, the inclination of the reference characteristic line a increases and is corrected in the direction of the characteristic line b, with the characteristic being varied continuously. Conversely, when the pressure signal 144 decreases, the inclination of the reference characteristic line a decreases and is corrected in the direction of the characteristic line c, with the characteristic being varied continuously. In this way, the second function generator calculates a target bottom flow rate serving as a reference according to the lever operation signal 141, and corrects the target bottom flow rate serving as a reference according to the change in the pressure signal 144 of the bottom side hydraulic chamber 3*a*1, whereby calculating a final target bottom flow rate.

Referring back to FIG. 3, the second function generator 102 outputs a final target bottom flow rate signal 102A to the second output conversion section 107 and the first multiplication calculation part 104. The second output conversion section 107 converts the input final target bottom flow rate signal 102A to a target electric motor speed, and outputs it to the inverter 9A as a revolution speed command signal 209A. Through this operation, the revolution speed of the electric motor 14 corresponding to the displacement volume of the hydraulic motor 13 is controlled. Further, the revolution speed command signal 209A is input to the second subtraction calculation part 110.

The first subtraction calculation part 103 inputs a demanded pump calculation signal 120A calculated by the demanded pump flow rate signal section 120 and a minimum flow rate signal from the minimum flow rate signal command section 114, calculates the deviation thereof as a demanded pump flow rate signal 103A, and outputs it to the second multiplication calculation part 105 and the second subtraction calculation part 112. Here, the method of calculating the demanded pump calculation signal 120A will be described with reference to FIG. 5.

As shown in FIG. 5, the demanded pump flow rate signal section 120 is equipped with a first function generator 145, a second function generator 146, a third function generator 147, a fourth function generator 148, a first addition calculation part 149, a second addition calculation part 150, a third addition calculation part 151, and a fifth function generator.

As shown in FIG. 5, the first function generator 145 inputs the lowering side pilot pressure Pd of the pilot valve 4A of the operation device 4 detected by the pressure sensor 41 as the lever operation signal 141. In the first function generator 145, the demanded pump flow rate with respect to the lever operation signal 141 is previously stored in a table. Similarly, the second function generator 146 inputs the raising side pilot pressure Pu of the pilot valve 4A of the operation device 4 detected by the pressure sensor 75 as a lever operation signal 175. In the second function generator 146, the demanded pump flow rate with respect to the lever operation signal 141 is previously stored in a table.

The output of the first function generator 145 and the output of the second function generator 146 are input to the first addition calculation part 149, and the first addition calculation part 149 outputs the value by addition of these to the third addition calculation part 151 as the demanded pump flow rate due to the operation device 4.

As shown in FIG. 5, the third function generator 147 inputs the pilot pressure on one side of the pilot valve 24A of the operation device 24 detected by the pressure sensor 42 as a lever operation signal 142. In the third function generator 147, the demanded pump flow rate with respect to the lever operation signal 142 is previously stored in a table. Similarly, the fourth function generator 148 inputs the pilot pressure on the other side of the pilot valve 24A of the operation device 24 detected by the pressure sensor 43 as a lever operation signal 143. In the fourth function generator 148, the demanded pump flow rate with respect to the lever operation signal 143 is previously stored in a table.

The output of the third function generator 147 and the output of the fourth function generator 148 are input to the second addition calculation part 150, and the second addition calculation part 150 outputs the value by addition of these to the third addition calculation part 151 as the demanded pump flow rate due to the operation device 24.

The third addition calculation part 151 calculates the hydraulic pump flow rate required when a combined operation by the operation device 4 and the operation device 24 is conducted, and outputs it to the fifth function generator 152. The fifth function generator 152 inputs the demanded pump flow rate from the third addition calculation part 151, and outputs a value with an upper limitation as the demanded pump calculation signal 120A. This is due to the fact that there is an upper limit to the flow rate that can be delivered from the hydraulic pump 10, and the upper limit value of the fifth function generator 152 is a value determined from the maximum displacement of the hydraulic pump 10.

In other words, the calculated demanded pump calculation signal 120A is a demanded pump flow rate which is a non-confluence time pump flow rate in the case where at least one of the boom cylinder 3*a*, which is the first hydraulic actuator, and the hydraulic actuator other than the boom cylinder 3*a*, which is the second hydraulic actuator, is driven solely by the hydraulic pump 10, there being no confluence of the hydraulic fluid delivered from the auxiliary hydraulic pump 15.

By the above control logic of the demanded pump flow rate signal section 120, the flow rate in accordance with the lever operation signal of the operation device is calculated in proper quantities. At the time of a combined operation, an enough flow rate required is calculated, and a demanded pump calculation signal 120A is calculated in a range not exceeding the upper limit of the flow rate that can be delivered from the hydraulic pump 10.

Referring back to FIG. 3, the first multiplication calculation part 104 inputs the final target bottom flow rate signal 102A from the second function generator 102 and the pressure signal 144 of the bottom side hydraulic chamber 3*a*1, calculates the value by multiplication of these as a recovery power signal 104A, and outputs it to the minimum value selection calculation section 108.

The second multiplication calculation part 105 inputs the delivery pressure of the hydraulic pump 10 detected by the pressure sensor 40 to one input end as a pressure signal 140, inputs the demanded pump flow rate signal 103A calculated by the first subtraction calculation part 103 to the other input end, calculates the value by multiplication of these as a demanded pump power signal 105A, and outputs it to the minimum value selection calculation section 108.

The minimum value selection calculation section 108 inputs the recovery power signal 104A from the first multiplication calculation part 104, and the demanded pump power signal 105A from the second multiplication calculation part 105. It selects the smaller one of these and calculates it as a target assist power signal 108A of the auxiliary hydraulic pump 15, and outputs it to the first division calculation part 109.

Here, when the apparatus efficiency is taken into account, it is more efficient to use the auxiliary hydraulic pump 15 as much as possible, which helps to reduce the loss, than to convert the recovered power to electrical energy by the electric motor 14 and to store it in the storage device 9C for re-use. Thus, the minimum value selection calculation section 108 selects the smaller one of the recovery power signal 104A and the demanded pump power signal 105A, whereby it is possible to supply the recovery power as much as possible to the auxiliary hydraulic pump 15 within a range not exceeding the demanded pump power signal 105A.

The first division calculation part 109 inputs the target assist power signal 108A from the minimum value selection calculation section 108 and the pressure signal 140 of the delivery pressure of the hydraulic pump 10, calculates the value obtained by dividing the target assist power signal 108A by the pressure signal 140 as a target assist flow rate signal 109A, and outputs it to the second division calculation part 110 and the second subtraction calculation part 112.

The second division calculation part 110 inputs the target assist flow rate 109A from the first division calculation part 109 and the revolution speed command signal 209A from the second output conversion section 107, and calculates the value obtained through division of the target assist flow rate signal 109A by the revolution speed command signal 209A as a target displacement signal 110A of the auxiliary hydraulic pump 15, and outputs it to the third output conversion section 111.

The third output conversion section 111 converts the input target displacement signal 110A to, for example, a tilting angle, and outputs it to the regulator 15A as a displacement command signal 215A. As a result, the displacement of the auxiliary hydraulic pump 15 is controlled.

The second subtraction calculation part 112 inputs the demanded pump flow rate signal 103A from the first subtraction calculation part 103, the target assist flow rate signal 109A from the first division calculation part 109, and the minimum flow rate signal from the minimum flow rate signal command section 114. The second subtraction calculation part 112 adds together the demanded pump flow rate signal 103A and the minimum flow rate signal to calculate the demanded pump calculation signal 120A of the demanded pump flow rate signal section 120, and calculates the deviation of the demanded pump calculation signal 120A and the target assist flow rate signal 109A as a target pump flow rate signal 112A, and outputs it to the fourth output conversion section 113.

The fourth output conversion section 113 converts the input target pump flow rate signal 112A to, for example, the displacement of the hydraulic pump 10, and outputs a control pressure command signal 210A serving as a control pressure according to the displacement to the solenoid proportional valve 74. The solenoid proportional valve 74 reduces the pressure output from the third high pressure selection valve 72 so as to attain a control pressure in accordance with the command from the controller 100, and outputs it to the regulator 10A. The regulator 10A controls the displacement of the hydraulic pump 10 in accordance with the input pressure.

Here, the second function generator 102, the first subtraction calculation part 103, the first multiplication calculation part 104, the second multiplication calculation part 105, the minimum value selection calculation section 108, the first division calculation part 109, the second division calculation part 110, and the demanded pump flow rate signal section 120 constitute a first calculation section configured to calculate the target displacement signal 110A which is the control command output to the regulator 15A such that the flow rate of the hydraulic fluid from the auxiliary hydraulic pump 15 flowing through the confluence line is lower than the demanded pump flow rate signal 120A which is the non-confluence time pump flow rate.

The first subtraction calculation part 103, the second subtraction calculation part 112, the minimum flow rate signal command section 114, and the demanded pump flow rate signal section 120 constitute a second calculation section configured to calculate the target pump flow rate 112A by subtracting the target assist flow rate signal 109A which is the flow rate of the hydraulic fluid from the auxiliary hydraulic pump 15 flowing through the confluence line from the demanded pump flow rate signal 120A which is the non-confluence time pump flow rate, and to calculate the target pump flow rate signal 112A which is the control command output to the solenoid proportional valve 74 such that the target pump flow rate 112A is attained.

Further, the second function generator 102, the first subtraction calculation part 103, the first multiplication calculation part 104, the second multiplication calculation part 105, the minimum value selection calculation section 108, the first division calculation part 109, the second division calculation part 110, the second subtraction calculation part 112, the minimum flow rate signal command section 114, and the demanded pump flow rate signal section 120 constitutes a third calculation section configured to: take in the operation amount of the operation device 4; calculate the recovery power signal 104A input to the hydraulic motor 13 on the basis of the return hydraulic fluid discharged from the boom cylinder 3*a* in accordance with this operation amount; calculate the demanded assist power necessary for supplying the flow rate of the hydraulic fluid from the auxiliary hydraulic pump 15 flowing through the confluence line; set the target assist power signal 108A so as not to exceed the recovery power signal 104A and the demanded assist power; and calculate the target displacement signal 110A and the target pump flow rate signal 112A which are control commands output to the regulator 15A and the solenoid proportional valve 74 such that this target assist power signal 108A is attained.

The first function generator 101 constitutes a fourth calculation section configured to take in the operation amount of the operation device 4 and calculate an interruption command output to the selector valve 7 in accordance with this operation amount.

Next, the operation by the control logic of the above-described hydraulic fluid energy regeneration apparatus of a work machine according to the first embodiment of the present invention will be described with reference to FIGS. 2, 3, and 5.

When the operation lever of the operation device 4 is operated in the boom lowering direction, the pilot pressure Pd is generated from the pilot valve 4A, is detected by the pressure sensor 41, and is input to the controller 100 as the lever operation signal 141. At this time, the delivery pressure of the hydraulic pump 10 is detected by the pressure sensor 40, and is input to the controller 100 as the pressure signal 140. Further, the pressure of the bottom side hydraulic chamber 3*a*1 of the boom cylinder 3*a* is detected by the pressure sensor 44, and is input to the controller 100 as the pressure signal 144.

In the controller 100, the lever operation signal 141 is input to the first function generator 101 and the second function generator 102. The first function generator 101 outputs the ON signal when the lever operation signal 141 exceeds the switching start point, and the ON signal is output to the solenoid selector valve 8 via the first output conversion section 106. As a result, the hydraulic fluid from the pilot hydraulic pump 11 is input to the pilot pressure receiving portion 7*a* of the selector valve 7 via the solenoid selector valve 8. As a result, the switching operation is performed so as to interrupt the bottom side hydraulic line 32 (to the closing side of the selector valve 7), and since the hydraulic line through which it flows into the tank 12 via the control valve 5 is interrupted, the return hydraulic fluid from the bottom side hydraulic chamber 3*a*1 of the boom cylinder 3*a* flows into the regeneration circuit 33 to flow into the hydraulic motor 13.

Further, the lever operation signal 141 and the pressure signal 144 of the bottom side hydraulic chamber 3*a*1 are input to the second function generator 102 in the controller 100, and the second function generator 102 calculates the final target bottom flow rate signal 102A in accordance with the lever operation signal 141 and the pressure signal 144 of the bottom side hydraulic chamber 3*a*1. The final target bottom flow rate signal 102A is converted to the target electric motor speed at the second output conversion section 107, and is output to the inverter 9A as the revolution speed command signal 209A.

Through the above operation, the revolution speed of the electric motor 14 is controlled to a desired revolution speed. As a result, the flow rate of the return hydraulic fluid discharged from the bottom side hydraulic chamber 3*a*1 of the boom cylinder 3*a* is adjusted, and a smooth cylinder operation in accordance with the lever operation of the operation device 4 can be realized.

On the other hand, as shown in FIG. 5, the demanded pump flow rate signal section 120 of the controller 100 calculates the demanded pump calculation signal 120A from the lever operation signals 141, 175, 142, and 143 detected by the pressure sensors 41, 75, 42, and 43, and the demanded pump calculation signal 120A is input to the first subtraction calculation part 103 together with the minimum flow rate signal from the minimum flow rate signal command section 114 shown in FIG. 3, with the first subtraction calculation part 103 calculating the demanded pump flow rate signal 103A.

The final target bottom flow rate signal 102A calculated by the second function generator 102 and the pressure signal 144 of the bottom side hydraulic chamber 3*a*1 are input to the first multiplication calculation part 104, and the first multiplication calculation part 104 calculates the recovery power signal 104A. The demanded pump flow rate signal 103A calculated by the first subtraction calculation part 103 and the pressure signal 140 of the hydraulic pump 10 are input to the second multiplication calculation part 105, and the second multiplication calculation part 105 calculates the demanded pump power signal 105A. The recovery power signal 104A and the demanded pump power signal 105A are input to the minimum value selection calculation section 108.

The minimum value selection calculation section 108 outputs the smaller one of the two inputs as the target assist power signal 108A. This means, with respect to the recovery power signal 104A, a power (energy amount) that can be used preferentially for the auxiliary hydraulic pump 15 is calculated in a range not exceeding the demanded pump power signal 105A. As a result, the loss in the conversion to electrical energy is suppressed to a minimum, and an efficient regenerating operation is performed.

The target assist power signal 108A calculated by the minimum value selection calculation section 108 and the pressure signal 140 of the delivery pressure of the hydraulic pump 10 are input to the first division calculation part 109, and the first division calculation part 109 calculates the target assist flow rate signal 109A.

The target assist flow rate signal 109A calculated by the first division calculation part 109 and the revolution speed command signal 209A calculated by the second output conversion section 107 are input to the second division calculation part 110, and the second division calculation part 110 calculates the target displacement signal 110A. The target displacement signal 110A is converted to, for example, the tilting angle, by the third output conversion section 111, and is output to the regulator 15A as the displacement command signal 215A.

As a result, the auxiliary hydraulic pump 15 is controlled so as to supply the hydraulic fluid in a flow rate as high as possible to the hydraulic pump 10 in a range not exceeding the demanded pump power signal 105A. As a result, it is possible to utilize the recovered power efficiently.

The demanded pump flow rate signal 103A calculated by the first subtraction calculation part 103, the target assist flow rate signal 109A calculated by the first division calculation part 109, and the minimum flow rate signal from the minimum flow rate signal command section 114 are input to the second subtraction calculation part 112, and the second subtraction calculation part 112 calculates the target pump flow rate signal 112A. The target pump flow rate signal 112A is converted to the displacement of the hydraulic pump 10 by the fourth output conversion section 113, and is output to the solenoid proportional valve 74 as the control pressure command signal 210A in accordance with the displacement of the hydraulic pump 10. The control pressure reduced by the solenoid proportional valve 74 is output to the regulator 10A.

As a result, the hydraulic pump 10 can reduce the displacement by an amount corresponding to the flow rate supplied from the auxiliary hydraulic pump 15, so that it is possible to reduce the output power of the hydraulic pump 10. Further, there is no difference in the flow rate of the hydraulic fluid supplied to the control valve 5 between the case where there is no supply from the auxiliary hydraulic pump 15 and the case where there is some supply therefrom, so that it is possible to secure a satisfactory operability in accordance with the operation lever of the operation device 24.

In the hydraulic fluid energy regeneration apparatus of a work machine according to the first embodiment of the present invention, the auxiliary hydraulic pump 15 which is a hydraulic pump mechanically connected to the hydraulic motor 13 for regeneration can be directly driven by the recovered energy, so that there is generated no loss when once storing the energy. As a result, the energy conversion loss can be reduced, so that it is possible to utilize the energy efficiently.

Further, in the hydraulic fluid energy regeneration apparatus of a work machine according to the first embodiment of the present invention, control is performed so as to reduce the displacement of the hydraulic pump 10 by an amount of the hydraulic fluid supplied from the auxiliary hydraulic pump 15, so that the flow rate of the hydraulic fluid supplied to the control valve 5 does not fluctuate. This helps to secure a satisfactory operability.

Embodiment 2

Figure 6:
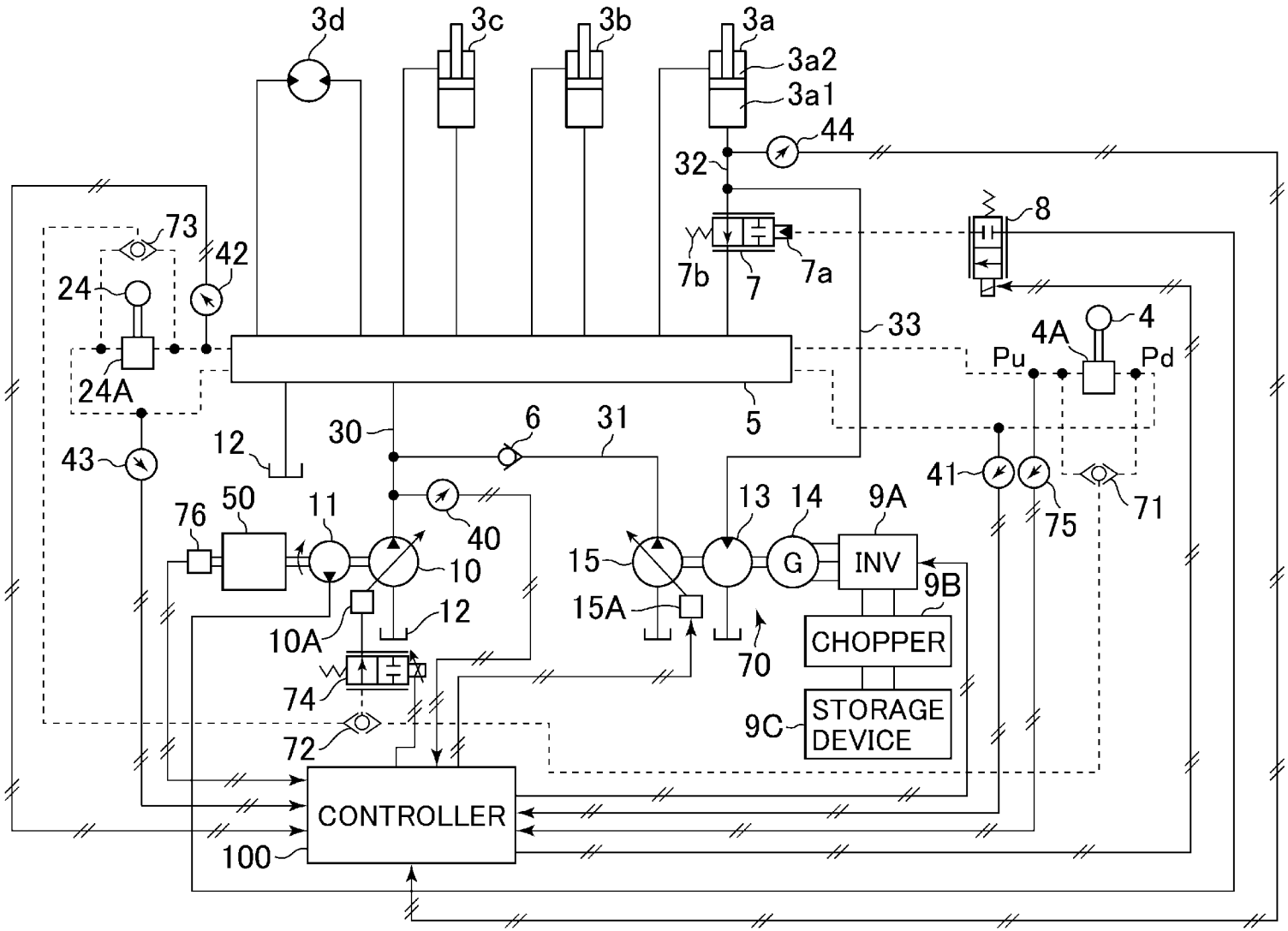
FIG. 6 is a schematic diagram of a drive control system, illustrating a hydraulic fluid energy regeneration apparatus of a work machine according to a second embodiment of the present invention.
Figure 7:
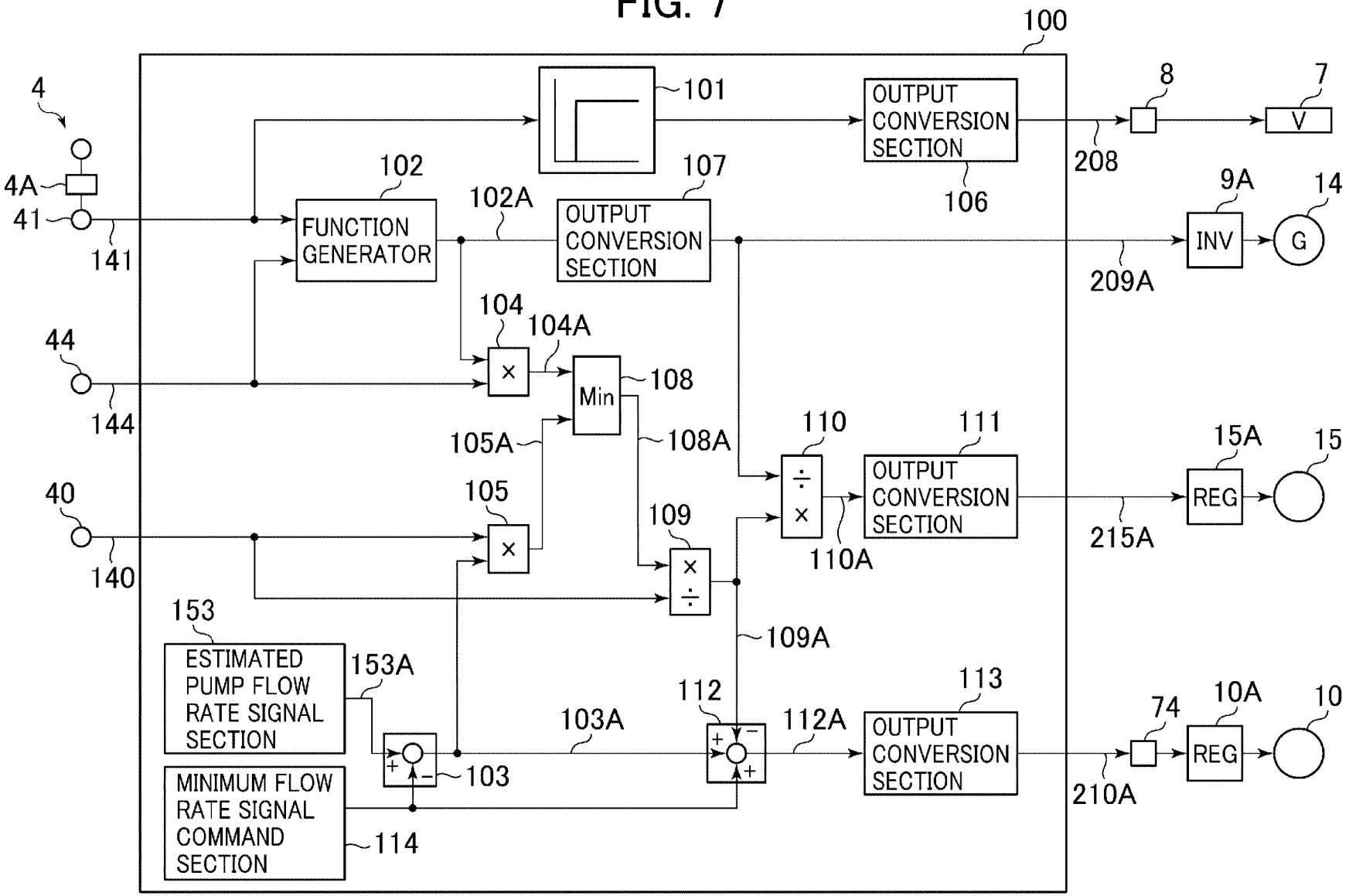
FIG. 7 is a block diagram of a controller constituting the hydraulic fluid energy regeneration apparatus of a work machine according to the second embodiment of the present invention.
Figure 8:
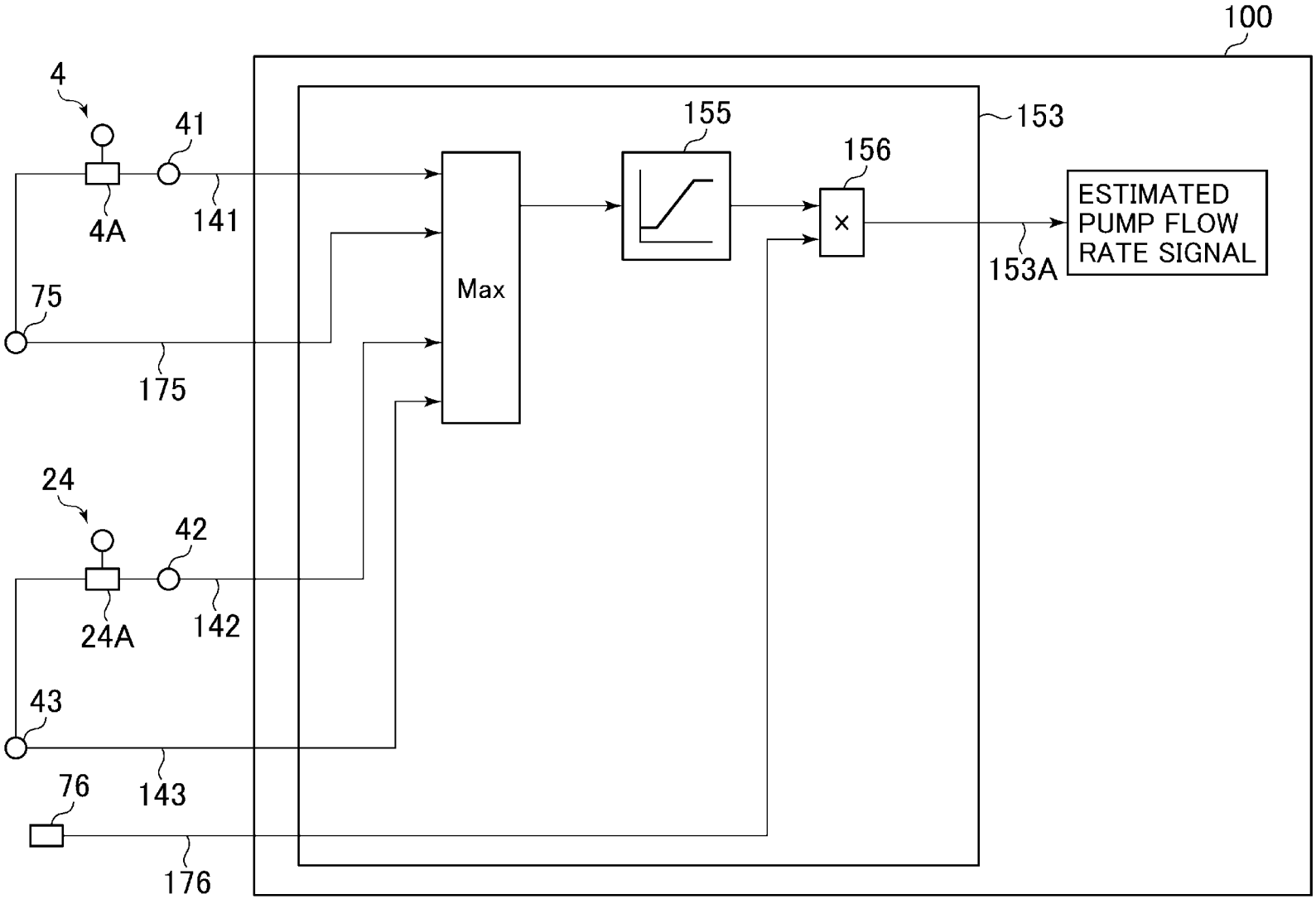
FIG. 8 is a block diagram illustrating how a hydraulic pump flow rate calculation is performed by the controller constituting the hydraulic fluid energy regeneration apparatus of a work machine according to the second embodiment of the present invention.

In the following, a hydraulic fluid energy regeneration apparatus of a work machine according to a second embodiment of the present invention will be described with reference to the drawings. FIG. 6 is a schematic diagram of a drive control system, illustrating the hydraulic fluid energy regeneration apparatus of a work machine according to the second embodiment of the present invention, FIG. 7 is a block diagram of a controller constituting the hydraulic fluid energy regeneration apparatus of a work machine according to the second embodiment of the present invention, and FIG. 8 is a block diagram illustrating how a hydraulic pump flow rate calculation is performed by the controller constituting the hydraulic fluid energy regeneration apparatus of a work machine according to the second embodiment of the present invention. In FIGS. 6 through 8, the same components as those of FIGS. 1 through 5 are indicated by the same reference numerals, and a detailed description thereof will be left out.

The hydraulic fluid energy regeneration apparatus of a work machine according to the second embodiment of the present invention shown in FIGS. 6 through 8 is formed by substantially the same hydraulic fluid source, work machine, etc. as those of the first embodiment, and differs in the following construction. The present embodiment differs in that there is provided a revolution speed sensor 76 for detecting the revolution speed of the rotation shaft of the engine 50. The engine speed signal detected by the revolution speed sensor 76 is input to the controller 100, and is used for the calculation of the control logic. Further, the controller 100 differs from that of the first embodiment in that an estimated pump flow rate signal section 153 is provided instead of the demanded pump flow rate signal section 120.

In the first embodiment, the demanded pump calculation signal 120A is calculated by the controller 100 in accordance with the lever operation signal, and a command signal is output to the solenoid proportional valve 74 so that the demanded pump calculation signal 120A may be attained, with the solenoid proportional valve 74 reducing and adjusting the pressure of the hydraulic fluid supplied to the regulator 10A in accordance with the command signal.

The present embodiment differs in that the displacement of the hydraulic pump 10, which is determined by each lever operation signal (pilot pressure), is estimated, and that only when the flow rate is assisted by the auxiliary hydraulic pump 15, control is performed so as to reduce the displacement of the hydraulic pump 10 by the solenoid proportional valve 74. That is, when the flow rate is not assisted by the auxiliary hydraulic pump 15, a pilot pressure in accordance with each lever operation amount is directly supplied to the regulator 10A, so that the flow rate of the hydraulic pump 10 is hydraulically controlled. Only when the flow rate is assisted by the auxiliary hydraulic pump 15, is a control command output to the solenoid proportional valve 74 and electrically reduced in pressure, controlling the flow rate of the hydraulic pump 10. As a result, there is generated time for hydraulically controlling the displacement of the hydraulic pump 10, so that it is possible to achieve an improvement in terms of responsiveness as compared with the case where the displacement of the hydraulic pump 10 is controlled constantly by the solenoid proportional valve 74.

As shown in FIG. 7, the estimated pump flow rate signal section 153 calculates an estimated pump flow rate signal 153A through a calculation described below, and outputs it to the first subtraction calculation part 103. That is, in the present embodiment, the estimated pump flow rate signal 153A is the estimated pump flow rate, which is the non-confluence time pump flow rate. A method of calculating the estimated pump flow rate signal 153A by the estimated pump flow rate signal section 153 will be described with reference to FIG. 8.

As shown in FIG. 8, the estimated pump flow rate signal section 153 is equipped with a maximum value selection part 154, a function generator 155, and a multiplication calculation part 156.

As shown in FIG. 8, the maximum value selection part 154 inputs the lowering side pilot pressure Pd of the pilot valve 4A of the operation device 4 detected by the pressure sensor 41 as the lever operation signal 141, and inputs the raising side pilot pressure Pu detected by the pressure sensor 75 as the lever operation signal 175. Further, it inputs the one side pilot pressure of the pilot valve 24A of the operation device 24 detected by the pressure sensor 42 as the lever operation signal 142, and inputs the other side pilot pressure detected by the pressure sensor 43 as the lever operation signal 143. The maximum value selection part 154 selects and calculates the maximum value of the input signal, and outputs it to the function generator 155. This is a calculation simulating the operation of the first through third high pressure selection valves 71, 73, and 72.

In the function generator 155, the characteristic of the regulator 10A is previously stored in a table. That is, the characteristic of the displacement of the hydraulic pump 10 with respect to the pressure signal of the hydraulic fluid input to the regulator 10A is stored. As a result, the displacement of the hydraulic pump 10 is estimated and calculated from the maximum value of the input lever operation signal, and is output to the multiplication calculation part 156.

The multiplication calculation part 156 inputs the hydraulic pump estimated displacement signal from the function generator 155 and a revolution speed signal 176 detected by the revolution speed sensor 76, and calculates and outputs the value by multiplication of these as the estimated pump flow rate signal 153A which is the flow rate delivered by the hydraulic pump 10.

Referring back to FIG. 7, when the target assist flow rate signal 109A is 0, that is, when there is no flow rate assist from the auxiliary hydraulic pump 15, the value of the estimated pump flow rate signal 153A calculated by the estimated pump flow rate signal section 153 is output as it is as the target pump flow rate signal 112A. The controller 100 outputs a command signal to the solenoid proportional valve 74 so that the estimated pump flow rate may be output as it is. As a result, at the solenoid proportional valve 74, no throttle control is performed with respect to the input pilot pressure, and the input pressure signal is output to the regulator 10A as it is. As a result, the hydraulic pump 10 is controlled to a displacement in accordance with the maximum value of the pilot valve of the operation lever. In this way, the displacement of the hydraulic pump 10 is hydraulically controlled, whereby it is possible to achieve an improvement in terms of the responsiveness of the hydraulic pump 10.

On the other hand, when the value of the target assist flow rate signal 109A is other than 0, that is, when there is a flow rate assist from the auxiliary hydraulic pump 15, a command corresponding to the flow rate attained through reduction by the amount of the flow rate assist is output to the solenoid proportional valve 74. As a result, at the solenoid proportional valve 74, throttle (pressure reduction) control is performed on the input pilot pressure, and the pressure is output to the regulator 10A, with control being performed so as to lower the displacement of the hydraulic pump 10. Through this control, the hydraulic pump 10 can reduce the displacement by an amount corresponding to the flow rate supplied from the auxiliary hydraulic pump 15, so that it is possible to reduce the output power of the hydraulic pump 10. Further, there is no difference in the flow rate of the hydraulic fluid supplied to the control valve 5 between the case where there is no supply from the auxiliary hydraulic pump 15 and the case where there is some supply, so that it is possible to secure a satisfactory operability in accordance with the operation lever of the operation device 24.

In the hydraulic fluid energy regeneration apparatus of a work machine according to the second embodiment of the present invention described above, it is possible to achieve the same effect as that of the first embodiment.

Further, in the hydraulic fluid energy regeneration apparatus of a work machine according to the second embodiment of the present invention described above, the displacement of the hydraulic pump 10 determined by each lever operation signals (pilot pressures) is estimated, and only when the flow rate is assisted by the auxiliary hydraulic pump 15, is control performed by the solenoid proportional valve 74 so as to reduce the displacement of the hydraulic pump 10, so that there is generated time for hydraulically controlling the displacement of the hydraulic pump 10, whereby it is possible to achieve an improvement in terms of the responsiveness of the control.

Embodiment 3

Figure 9:
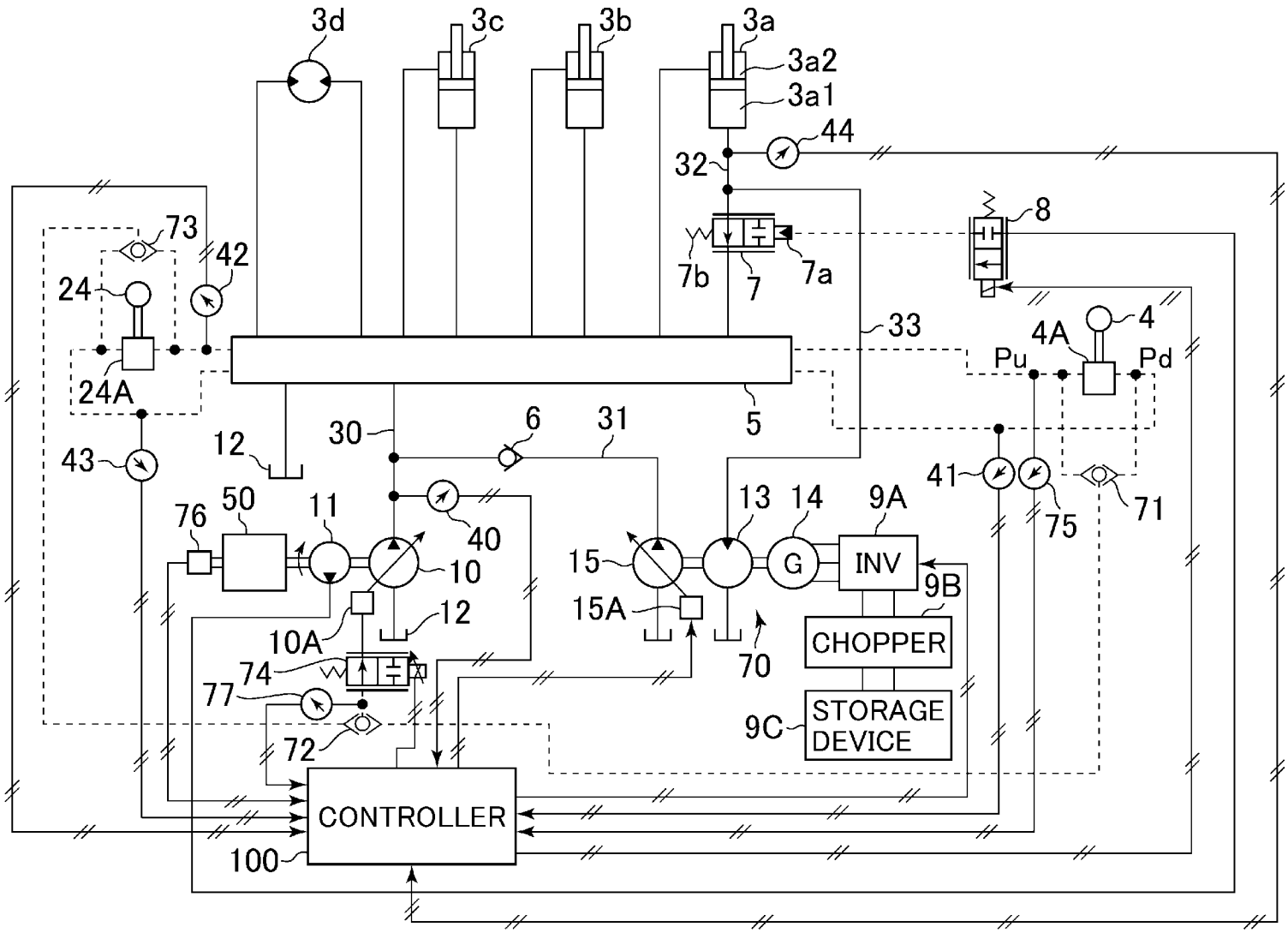
FIG. 9 is a schematic diagram of a drive control system, illustrating a hydraulic fluid energy regeneration apparatus of a work machine according to a third embodiment of the present invention.
Figure 10:
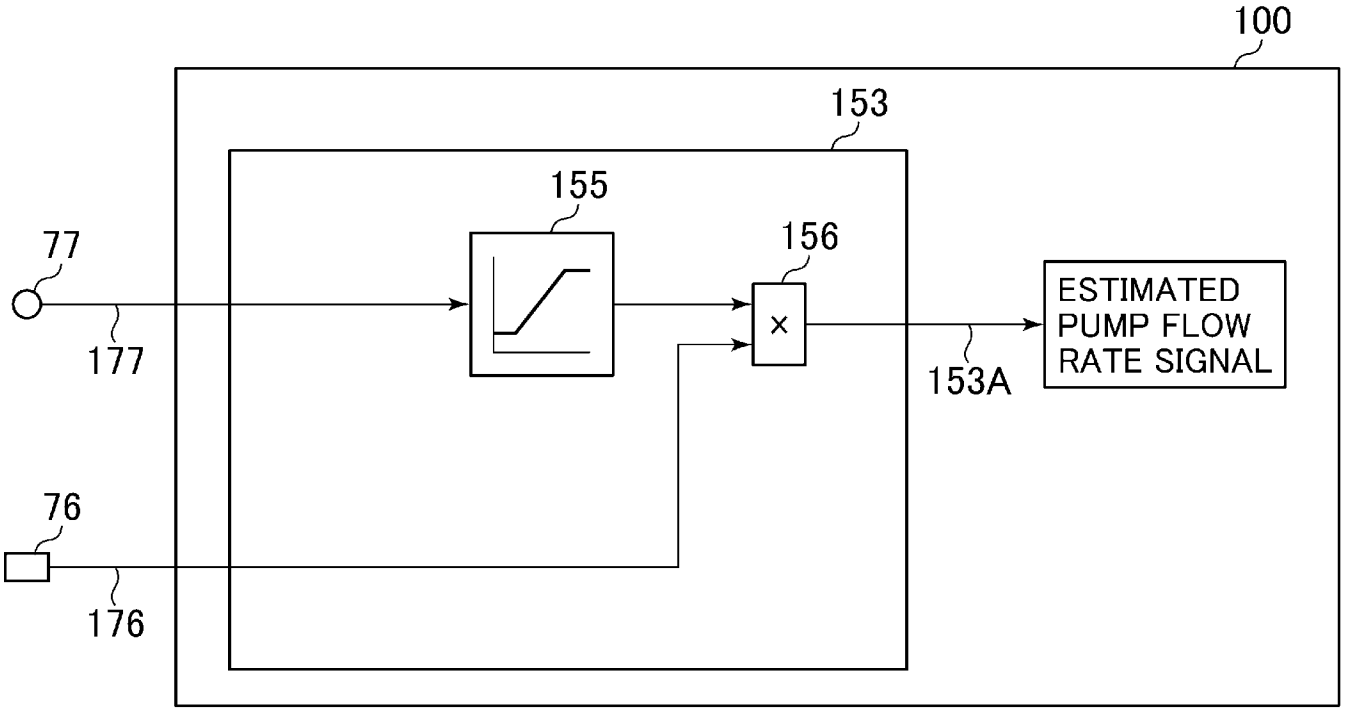
FIG. 10 is a block diagram illustrating how a hydraulic pump flow rate calculation is performed by a controller constituting the hydraulic fluid energy regeneration apparatus of a work machine according to the third embodiment of the present invention.

In the following, a hydraulic fluid energy regeneration apparatus of a work machine according to a third embodiment of the present invention will be described with reference to the drawings. FIG. 9 is a schematic diagram of a drive control system, illustrating the hydraulic fluid energy regeneration apparatus of a work machine according to the third embodiment of the present invention, and FIG. 10 is a block diagram illustrating how a hydraulic pump flow rate calculation is performed by a controller constituting the hydraulic fluid energy regeneration apparatus of a work machine according to the third embodiment of the present invention. In FIGS. 9 and 10, the components that are the same as those shown in FIGS. 1 through 8 are indicated by the same reference numerals, and a detailed description thereof will be left out.

The hydraulic fluid energy regeneration apparatus of a work machine according to the third embodiment of the present invention shown in FIGS. 9 and 10 is composed of the hydraulic fluid source, work machine, etc. that are substantially the same as those of the second embodiment, and differs therefrom in the following construction. The present embodiment differs in that a pressure sensor 77 is provided in the piping connecting the output port of the third high pressure selection valve 72 and the input port of the solenoid proportional valve 74. The input pressure signal (pump control signal) of the solenoid proportional valve 74 detected by the pressure sensor 77 is input to the controller 100, and is used for control logic calculation. Further, this embodiment differs from the second embodiment in that, in the estimated pump flow rate signal section 153 of the controller 100, the input pressure signal of the solenoid proportional valve 74 (pump control signal) is used instead of the lever operation signal in order to estimate the pump flow rate.

The regulator 10A which is the second adjuster shown in FIG. 9 is equipped with a pump control signal unit and a pump control signal correction unit, and the pilot pressure (pump control signal) generated in the pump control signal unit is adjusted at the pump control signal correction unit before being supplied to the regulator 10A. The pump control signal unit is equipped with the pilot valve 4A of the operation device 4 generating the pilot pressure for controlling the displacement of the second hydraulic pump 10, the pilot valve 24A of the operation device 24, the first high pressure selection valve 71, the second high pressure selection valve 73, and the third high pressure selection valve 72. The pump control signal correction unit is equipped with the solenoid proportional valve 74 reducing the pilot pressure input in accordance with a command signal from the controller 100.

In the present embodiment, the displacement of the hydraulic pump 10 is estimated and calculated from the above-mentioned pump control signal, and by calculation with this and the revolution speed signal, the estimated pump flow rate, which is the non-confluence time pump flow rate, is calculated.

The estimated pump flow rate signal section 153 of the present embodiment shown in FIG. 10 differs from the estimated pump flow rate signal section 153 of the second embodiment shown in FIG. 8 in the following point. In the present embodiment, the input signal of the function generator 155 is a pressure signal 177 (pump control signal) detected by the pressure sensor 77 and input to the solenoid proportional valve 74 instead of each lever operation signal detected by each pressure sensor. Due to this arrangement, the maximum value selection part 154 is omitted. The function generator 155 stores the characteristic of the displacement of the hydraulic pump 10 with respect to the pressure signal of the hydraulic fluid input to the regulator 10A. As a result, the displacement of the hydraulic pump 10 is estimated and calculated, and is output to the multiplication calculation part 156.

The multiplication calculation part 156 inputs the hydraulic pump estimated displacement signal from the function generator 155 and the revolution speed signal 176 detected by the revolution speed sensor 76, and calculates the value by multiplication of these as the estimated pump flow rate signal 153A which is the flow rate delivered by the hydraulic pump 10.

In the second embodiment, the pressure selected by the third high pressure selection valve 72 is calculated through the calculation of each lever operation signal and the maximum value selection part 154, whereas, in the present embodiment, the pressure selected by the third high pressure selection valve 72 is directly detected by the pressure sensor 77. As a result, there is no need to perform the above-mentioned calculation, making it possible to simplify the operation.

In the hydraulic fluid energy regeneration apparatus of a work machine according to the third embodiment of the present invention described above, it is possible to achieve the same effect as that of the first embodiment.

Embodiment 4

Figure 11:
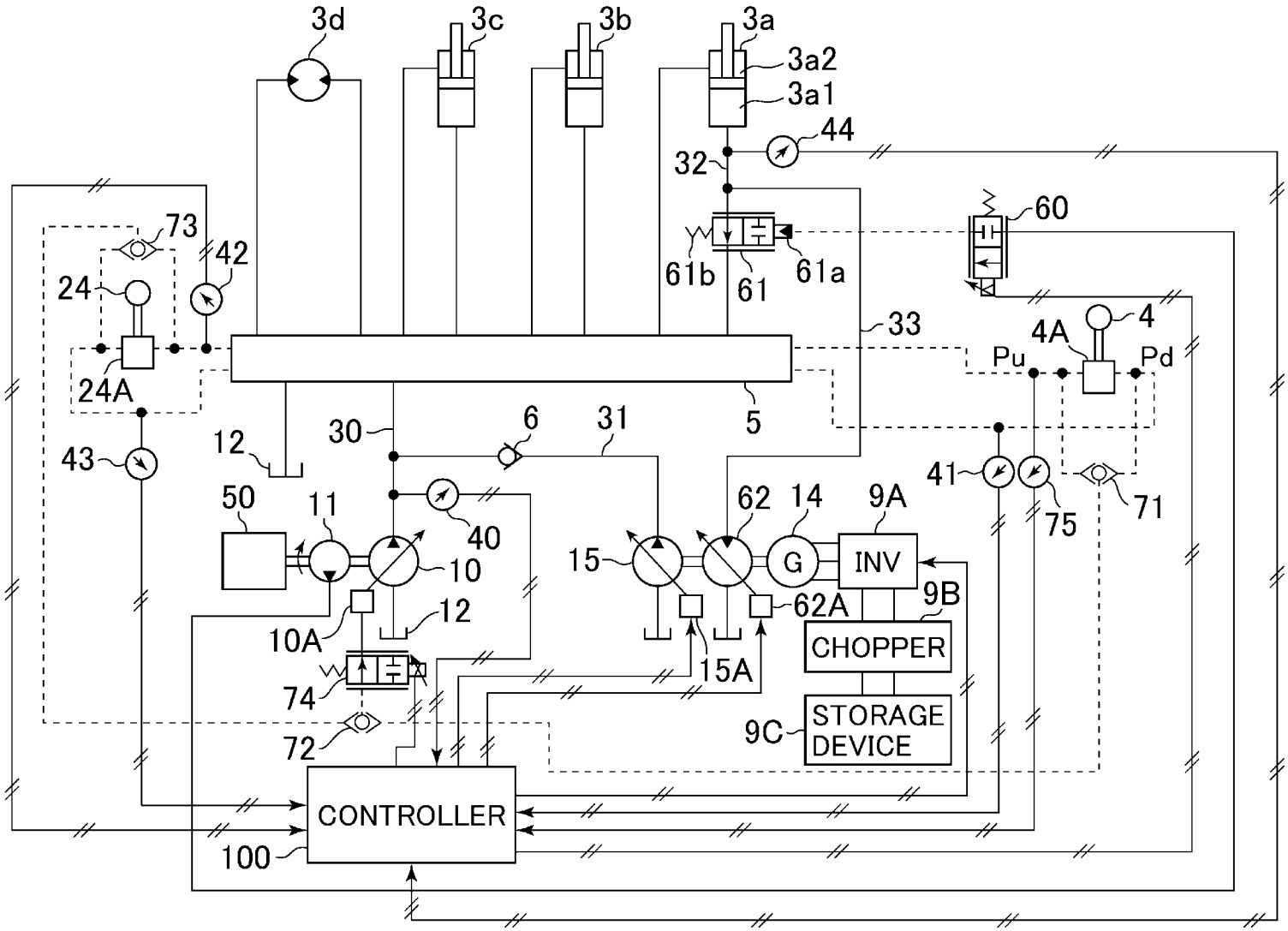
FIG. 11 is a schematic view of a drive control system, illustrating a hydraulic fluid energy regeneration apparatus of a work machine according to a fourth embodiment of the present invention.

In the following, a hydraulic fluid energy regeneration apparatus of a work machine according to a fourth embodiment of the present invention will be described with reference to the drawings. FIG. 11 is a schematic view of a drive control system, illustrating the hydraulic fluid energy regeneration apparatus of a work machine according to the fourth embodiment of the present invention, and FIG. 12 is a block diagram of a controller constituting the hydraulic fluid energy regeneration apparatus of a work machine according to the fourth embodiment of the present invention.

Figure 12:
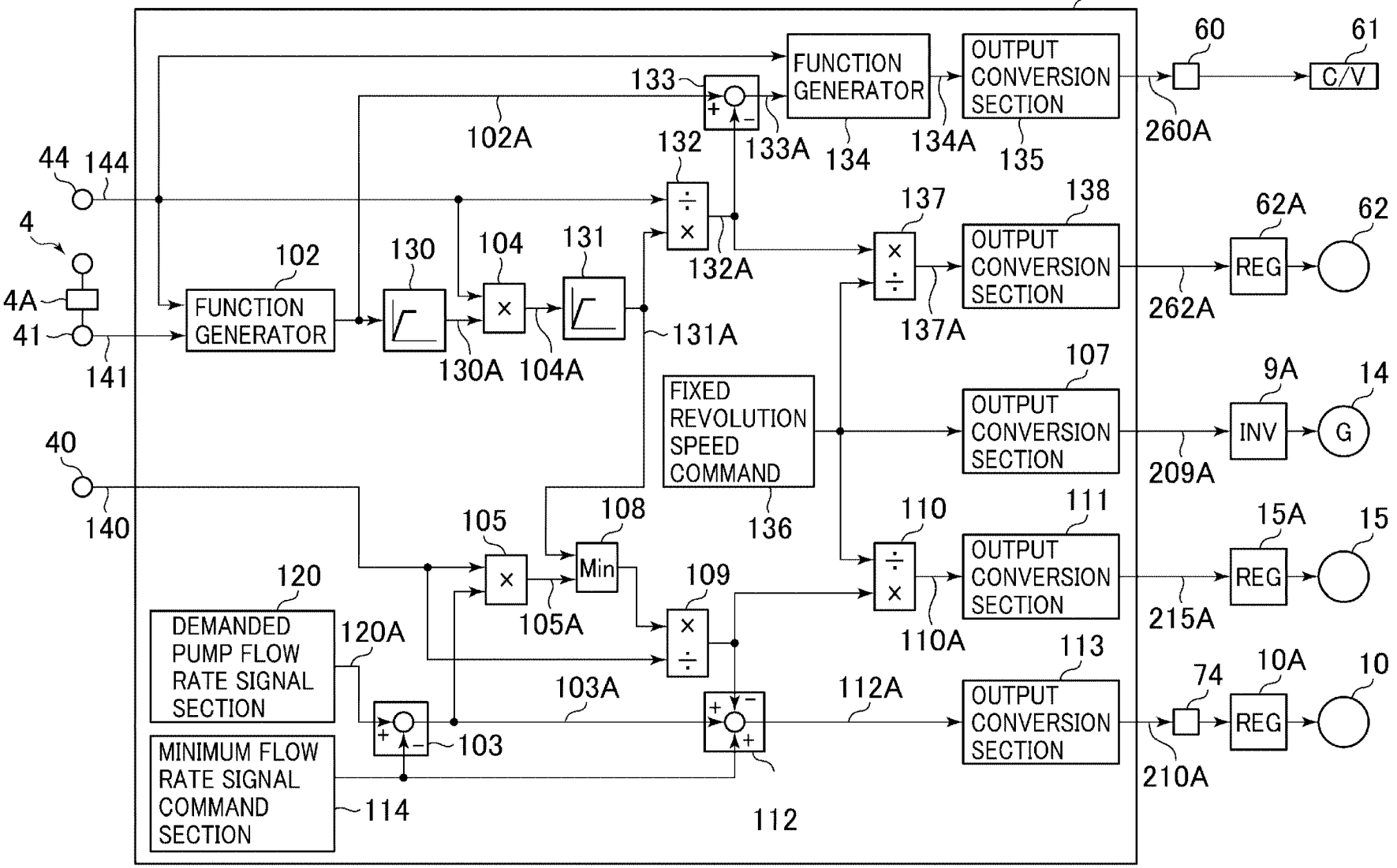
FIG. 12 is a block diagram of a controller constituting the hydraulic fluid energy regeneration apparatus of a work machine according to the fourth embodiment of the present invention.

In FIGS. 11 and 12, the same components as those of FIGS. 1 through 10 are indicated by the same reference numerals, and a detailed description thereof will be omitted.

The hydraulic fluid energy regeneration apparatus of a work machine according to the fourth embodiment of the present invention shown in FIGS. 11 and 12 are formed by the hydraulic fluid source, work machine, etc. that are substantially the same as those of the first embodiment, and differs in the following construction. The present embodiment differs in that the solenoid selector valve 8 is changed to a solenoid proportional pressure reducing valve 60, that the selector valve 7 is changed to a control valve 61, that the hydraulic motor 13 is changed to a variable displacement hydraulic motor 62, and that there is provided a motor regulator 62A varying the motor displacement. The motor regulator 62A varies the displacement of the variable displacement hydraulic motor 62 by a command from the controller 100. Further, the controller 100 is different from that of the first embodiment in that it is provided with a flow rate limiting calculation section 130, a power limiting calculation section 131, a third division calculation part 132, a third subtraction calculation part 133, a third function generator 134, a fifth output conversion section 135, a fixed revolution speed command section 136, a fourth division calculation part 137, and a sixth output conversion section 138.

In the present embodiment, the return hydraulic fluid from the bottom side hydraulic chamber 3*a*1 of the boom cylinder 3*a* can be branched by the control valve 61. At the same time, the electric motor 14 is rotated at a fixed revolution speed, and the displacement of the variable displacement hydraulic motor 62 is controlled, whereby the regeneration flow rate is controlled. As a result, even in the case where energy/flow-rate in excess of the maximum power of the electric motor 14 or the maximum recovery flow rate of the variable displacement hydraulic motor 62 is discharged from the boom cylinder 3*a*, it is possible to prevent damage of the apparatus, and to secure the operability of the boom. Referring to FIG. 11, the difference from the first embodiment will be described.

Instead of the selector valve 7, the control valve 61 is provided in the bottom side hydraulic line 32. The control valve 61 performs branching control on the flow rate of the portion of the return hydraulic fluid from the bottom side hydraulic chamber 3*a*1 of the boom cylinder 3*a* which is discharge to the tank 12 via the control valve 5.

The control valve 61 has a spring 61*b* on one end side, and a pilot pressure receiving portion 61*a* on the other end side. The spool of the control valve 61 moves in accordance with the pressure of the pilot hydraulic fluid input to the pilot pressure receiving portion 61*a*, so that the area of the opening through which the hydraulic fluid passes is controlled, and the valve is completely closed when the pressure of the pilot hydraulic fluid is a fixed value or more. Due to this construction, it is possible to control the flow rate of the portion of the return hydraulic fluid from the bottom side hydraulic chamber 3*a*1 of the boom cylinder 3*a* which is discharged to the tank 12 via the control valve 5. To the pilot pressure receiving portion 61*a*, there is supplied the pilot hydraulic fluid from the pilot hydraulic pump 11 via the solenoid proportional pressure reducing valve 60 described below.

The hydraulic fluid output from the pilot hydraulic pump 11 is input to the input port of the solenoid proportional pressure reducing valve 60 according to the present embodiment. On the other hand, to the operation portion of the solenoid proportional pressure reducing valve 60, there is input a command signal output from the controller 100. In accordance with this command signal, the spool position of the solenoid proportional pressure reducing valve 60 is adjusted, whereby the pressure of the pilot hydraulic fluid supplied from the pilot hydraulic pump 11 to the pilot pressure receiving portion 61*a* of the control valve 61 is adjusted as appropriate.

The controller 100 outputs a control command to the solenoid proportional pressure reducing valve 60 such that a target discharge flow rate for branching at the control valve 61 calculated in the controller may be attained, thereby adjusting the opening area of the control valve 61.

Next, an outline of the control by the controller 100 in the present embodiment will be described with reference to FIG. 12. Referring to FIG. 12, the portions that are different from those of the first embodiment will be described.

In the present embodiment, a target opening area signal 134A from the third function generator 134 is output to a fifth output conversion section 135, and the fifth output conversion section 135 converts the input target opening area signal 134A to a control command of the solenoid proportional pressure reducing valve 60, and outputs it to the solenoid proportional pressure reducing valve 60 as a solenoid valve command signal 260A. As a result, the opening degree of the control valve 61 is controlled, and it is possible to control the flow rate of the portion of the return hydraulic fluid from the bottom side hydraulic chamber 3*a*1 of the boom cylinder 3*a* which is discharge to the tank 12 via the control valve 5. Further, a target displacement signal 137A from the fourth division calculation part 137 is output to the sixth output conversion section 138, and the sixth output conversion section 138 converts the input target displacement signal 137A to, for example, a tilting angle, and outputs it to the motor regulator 62A as a displacement command signal 262A. As a result, the displacement of the variable displacement hydraulic motor 62 is controlled.

In the controller 100 of the present embodiment, the first function generator 101 and the first output conversion section 106 of the first embodiment are omitted, and, in addition to the remaining calculation parts, it is equipped with the flow rate limiting calculation section 130, the power limiting calculation section 131, the third division calculation part 132, the third subtraction calculation part 133, the third function generator 134, the fifth output conversion section 135, the fixed revolution speed command section 136, the fourth division calculation part 137, and the sixth output conversion section 138.

As shown in FIG. 6, the flow rate limiting calculation section 130 inputs the final target bottom flow rate signal 102A calculated by the second function generator 102, and outputs a limitation flow rate signal 130A limited to the upper limit of the maximum recovery flow rate of the variable displacement hydraulic motor 62. Generally speaking, a hydraulic motor is determined in maximum flow rate. Thus, a characteristic in conformity with the specification of the apparatus is set. The limitation flow rate signal 130A is output to the first multiplication calculation part 104.

The first multiplication calculation part 104 inputs the limitation flow rate signal 130A from the flow rate limiting calculation section 130 and the pressure signal 144 of the bottom side hydraulic chamber 3*a*1, calculates the value by multiplication of these as the recovery power signal 104A, and outputs it to the power limiting calculation section 131.

The power limiting calculation section 131 inputs the recovery power signal 104A calculated by the first multiplication calculation part 104, and outputs a limitation recovery power signal 131A limited to the upper limit of the maximum power of the electric motor 14. Also regarding the electric motor 14, the maximum power is generally fixed, so that a characteristic in conformity with the specifications of the apparatus is set. The limitation recovery power signal 131A is output to the third division calculation part 132 and to the minimum selection calculation section 108. Due to the limitation by the flow rate limiting calculation section 130 and the power limiting calculation section 131, it is possible to prevent damage of the apparatus.

The third division calculation part 132 inputs the limitation recovery power signal 131A from the power limiting calculation section 131 and the pressure signal 144 of the bottom side hydraulic chamber 3*a*1, calculates a value obtained by dividing the limitation recovery power signal 131A by the pressure signal 144 as a target recovery flow rate signal 132A, and outputs it to the third subtraction calculation part 133 and to the fourth division calculation part 137.

The third subtraction calculation part 133 inputs the final target bottom flow rate signal 102A from the second function generator 102 and the target recovery flow rate signal 132A from the third division calculation part 132, calculates the deviation thereof as a target discharge flow rate signal 133A for branching at the control valve 61, and outputs it to the third function generator 134.

The third function generator 134 inputs the pressure of the bottom side hydraulic chamber 3*a*1 of the boom cylinder 3*a* detected by the pressure sensor 44 to one input end as the pressure signal 144, and outputs the target discharge flow rate signal 133A from the third subtraction calculation part 133 for branching at the control valve 61 to the other input end. From these input signals, the target opening area of the control valve 61 is calculated based on an orifice formula, and the target opening area signal 134A is output to the fifth output conversion section 135.

Here, the target opening area A of the control valve 61 is calculated by the following equations (1) and (2). Assuming that the target discharge flow rate is Qt, that the flow rate coefficient is C, that the pressure of the bottom side hydraulic chamber 3*a*1 of the boom cylinder 3*a* is Pb, that the opening area of the control valve 61 is A, and that the tank pressure is 0 MPa, $$Qt=CA\sqrt{Pb} \tag{1}$$

When the above equation is solved with respect to A, $$A_0=Q_0/(C\sqrt{P_b}) \tag{2}$$

Thus, it is possible to calculate the opening area of the control valve 61 by equation (2).

The fifth output conversion section 135 converts the input target opening area signal 134A to a control command of the solenoid proportional pressure reducing valve 60, and outputs it to the solenoid proportional pressure reducing valve 60 as the solenoid valve command signal 260A. Through this operation, the opening degree of the control valve 61 is controlled, and the flow rate to be branched by the control valve 61 is controlled.

The fixed revolution speed command section 136 outputs a revolution speed command signal of the electric motor to the second output conversion section 107 in order to rotate the electric motor 14 at a fixed revolution speed, which is the maximum revolution speed. The second output conversion section 107 converts the input revolution speed command signal to a target electric motor speed, and outputs it to the inverter 9A as the revolution speed command signal 209A.

The fixed revolution speed command section 136 also outputs the revolution speed command signal of the electric motor to the other end of the second division calculation part 110, and to the other end of the fourth division calculation part 137.

The second division calculation part 110 inputs the target assist flow rate signal 109A from the first division calculation part 109 and the electric motor speed command signal from the fixed revolution speed command section 136, calculates the value obtained by dividing the target assist flow rate signal 109A by the electric motor speed command signal as the target displacement signal 110A of the auxiliary hydraulic pump 15, and outputs it to the third output conversion section 111.

The fourth division calculation part 137 inputs the target recovery flow rate signal 132A from the third division calculation part 132 and the electric motor speed command signal from the fixed revolution speed command section 136, calculates the value obtained by dividing the target recovery flow rate signal 132A by the electric motor speed command signal as the target displacement signal 137A of the variable displacement hydraulic motor 62, and outputs it to the sixth output conversion section 138.

The sixth output conversion section 138 converts the input target displacement signal 137A to, for example, a tilting angle, and outputs it to the motor regulator 62A as the displacement command signal 262A. Through this operation, the displacement of the variable displacement hydraulic motor 62 is controlled.

Here, the second function generator 102, the first multiplication calculation part 104, the flow rate limiting calculation section 130, the power limiting calculation section 131, the third division calculation part 132, the third subtraction calculation part 133, the third function generator 134, the fixed revolution speed command section 136, and the fourth division calculation part 137 constitute a fifth calculation section configured to calculate the target opening area signal 134A, which is a control command output to the solenoid proportional pressure reducing valve 60 controlling the opening degree of the control valve 61 so as to distribute the power discharged from the boom cylinder 3*a* to the discharge circuit such that the recovery power signal 104A does not exceed the maximum power of the electric motor 14.

Further, the second function generator 102, the first multiplication calculation part 104, the flow rate limiting calculation section 130, the power limiting calculation section 131, the third division calculation part 132, the third subtraction calculation part 133, the third function generator 134, the fixed revolution speed command section 136, and the fourth division calculation part 137 constitute a seventh calculation section configured to calculate the target opening area signal 134A, which is a control command output to the solenoid proportional pressure reducing valve 60 controlling the opening degree of the control valve 61 so as to distribute the power discharged from the boom cylinder 3*a* to the discharge circuit such as not to exceed the limitation flow rate signal 130A, which is the maximum flow rate that can be input to the variable displacement hydraulic motor 62.

Next, the operation of the hydraulic fluid energy regeneration apparatus of a work machine according to the fifth embodiment of the present invention described above by the control logic will be described with reference to FIGS. 11 and 12.

The final target bottom flow rate signal 102A output from the second function generator 102 shown in FIG. 12 is limited to the limitation flow rate signal 130A of the maximum flow rate of the variable displacement hydraulic motor 62 by the flow rate limiting calculation section 130. Due to this operation, limitation is effected such that no flow rate as specified or more is caused to flow to the variable displacement hydraulic motor 62, making it possible to prevent damage of the variable displacement hydraulic motor 62.

Further, this limited final target bottom flow rate signal 102A is input to the first multiplication calculation part 104 together with the pressure signal 144 of the bottom side hydraulic chamber 3*a*1, and the recovery power signal 104A is calculated.

The calculated recovery power signal 104A is limited by the limiting recovery power signal 131A limited to the upper limit of the maximum power of the electric motor 14 by the power limiting calculation section 131. As a result, it is possible to prevent excessive energy from being input to the electric motor shaft, and to prevent damage of the apparatus and overspeed.

The limiting recovery power signal 131A output from the power limiting calculation section 131 is input to the third division calculation part 132 along with the pressure signal 144 of the bottom side hydraulic chamber 3*a*1, and the target recovery flow rate signal 132A is calculated.

Further, the target recovery flow rate signal 132A is input to the third subtraction calculation part 133 along with the final target bottom flow rate signal 102A, and there is calculated the target discharge flow rate signal 133A for branching at the control valve 61 in order to realize a boom cylinder speed as desired by the operator.

The target discharge flow rate signal 133A is input to the third function generator 134 along with the pressure signal 144 of the bottom side hydraulic chamber 3*a*1, and the target opening area of the control valve 61 is calculated. The signal of this target opening area is output to the solenoid proportional pressure reducing valve 60 as the solenoid valve command signal 260A via the fifth output conversion section 135.

As a result, the discharge hydraulic fluid from the boom cylinder 3*a* shown in FIG. 11 is also branched to the control valve 61, and is caused to flow at a flow rate that cannot be recovered by the variable displacement hydraulic motor 62, making it possible to secure a boom cylinder speed as desired by the operator.

Referring back to FIG. 12, the target recovery flow rate signal 132A output from the third division calculation part 132 is input to the fourth division calculation part 137 together with the electric motor speed command signal from the fixed revolution speed command section 136, and the target displacement of the variable displacement hydraulic motor 62 is calculated. The signal of this target displacement is output to the motor regulator 62A as the displacement command signal 262A via the sixth output conversion section 138.

As a result, in accordance with the specifications of the apparatus connected to the rotation shaft, hydraulic working fluid flows into the variable displacement hydraulic motor 62 at a flow rate limited in flow rate and in power. As a result, no excessive power is input, so that it is possible to prevent damage of the apparatus and generation of overspeed.

While in the present embodiment described above the flow rate limitation of the recovery power and the limitation of the power are effected simultaneously, this should not be construed restrictively. It is desirable to perform the designing through appropriate selection in conformity with the specifications of the apparatus. For example, when the torque of the electric motor is sufficient, and there is no need to perform power limitation, a control logic in which solely the flow rate control is effected may be prepared.

In the hydraulic fluid energy regeneration apparatus of a work machine according to the fourth embodiment of the present invention described above, it is possible to achieve the same effect as that of the first embodiment.

Further, in the hydraulic fluid energy regeneration apparatus of a work machine according to the fourth embodiment of the present invention described above, the hydraulic working fluid flows into the variable displacement hydraulic motor 62 for regeneration in a flow rate limited in flow rate and in power in accordance with the specifications of the apparatus, so that no excessive power is input. As a result, it is possible to prevent generation of damage of the apparatus and generation of overspeed, making it possible to achieve an improvement in terms of reliability.

Embodiment 5

Figure 13:
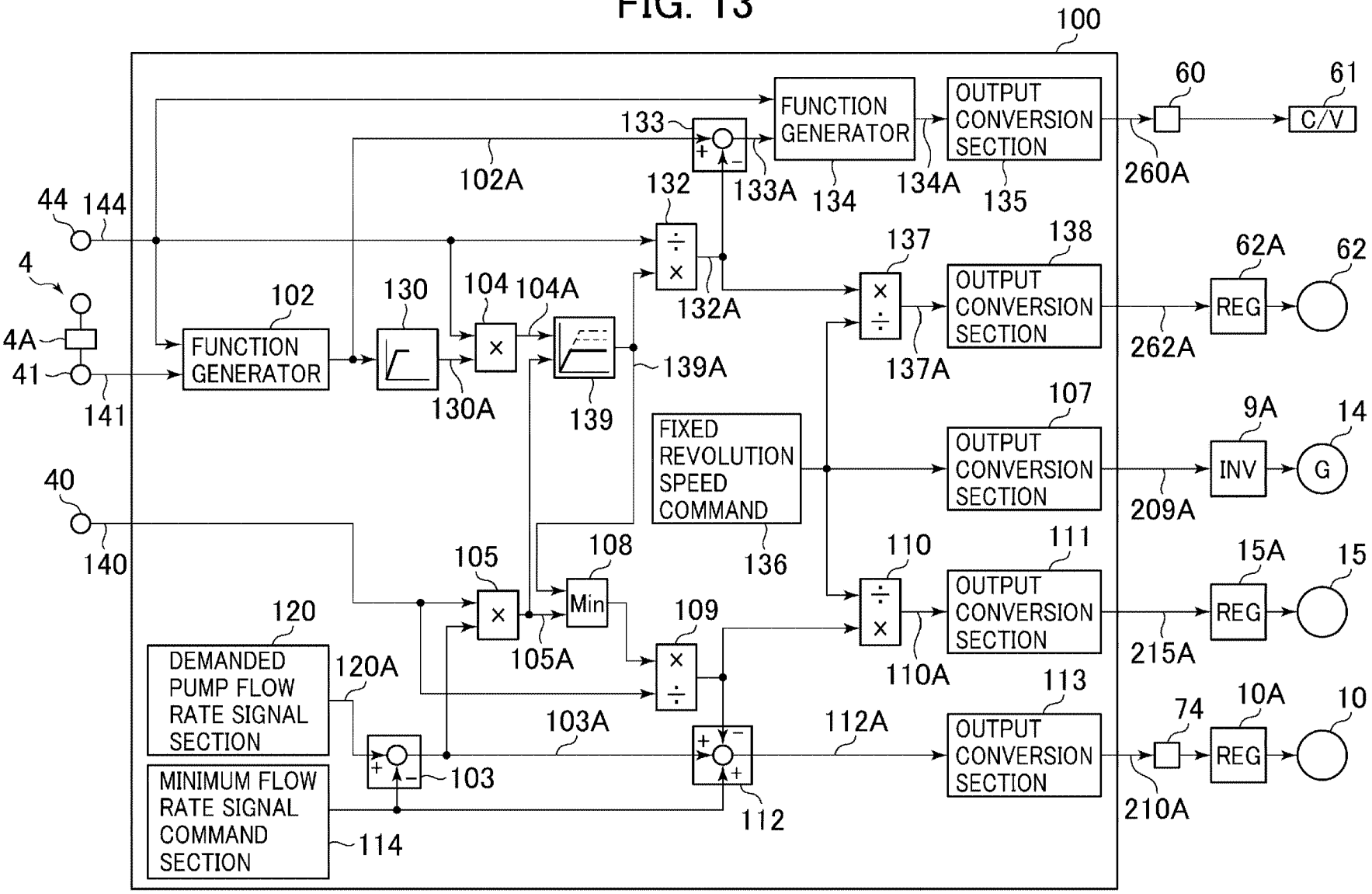
FIG. 13 is a block diagram of a controller constituting a hydraulic fluid energy regeneration apparatus of a work machine according to a fifth embodiment of the present invention.
Figure 14:
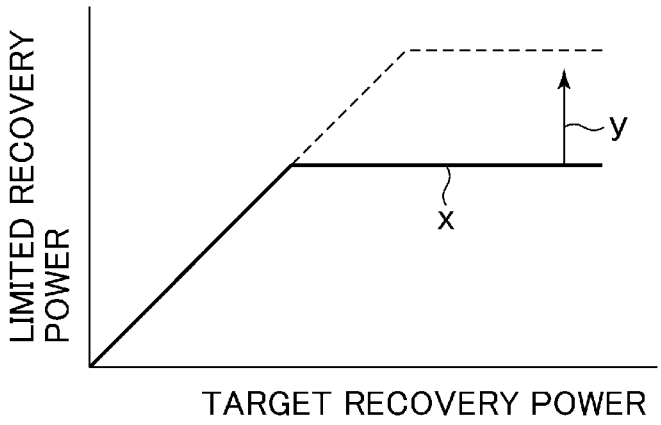
FIG. 14 is a characteristic chart illustrating the contents of a variable power limiting calculation section of the controller constituting the hydraulic fluid energy regeneration apparatus of a work machine according to the fifth embodiment of the present invention.

In the following, a hydraulic fluid energy regeneration apparatus of a work machine according to a fifth embodiment of the present invention will be described. FIG. 13 is a block diagram of a controller constituting the hydraulic fluid energy regeneration apparatus of a work machine according to the fifth embodiment of the present invention, and FIG. 14 is a characteristic chart illustrating the contents of a variable power limiting calculation section of the controller constituting the hydraulic fluid energy regeneration apparatus of a work machine according to the fifth embodiment of the present invention. In FIGS. 13 and 14, the components that are the same as those shown in FIGS. 1 through 12 are indicated by the same reference numerals, and a detailed description thereof will be left out.

The hydraulic fluid energy regeneration apparatus of a work machine according to the fifth embodiment of the present invention shown in FIGS. 13 and 14 is composed of the same hydraulic fluid source, work machine, etc. as those of the fourth embodiment, and differs in the construction of the control logic. The present embodiment differs from the fourth embodiment in that there is provided a variable power limiting calculation section 139 instead of the power limiting calculation section 131 of the fourth embodiment. In the fourth embodiment, the inflow flow rate, etc. of the hydraulic working fluid to the variable displacement hydraulic motor 62 are limited solely by the maximum power of the electric motor 14, whereas, in the present embodiment, limitation is effected with the sum total of the maximum power of the electric motor 14 and the demanded pump power of the auxiliary hydraulic pump 15. Due to this arrangement, the upper limit of the power limitation is raised, so that the recovered energy can be further increased, and an improvement is achieved in terms of fuel efficiency.

As shown in FIG. 13, the variable power limiting calculation section 139 inputs the recovery power signal 104A calculated by the first multiplication calculation part 104 and the demanded pump power signal 105A calculated by the second multiplication calculation part 105, and outputs a limited recovery power signal 139A in accordance with the upper limit of the maximum power of the electric motor 14 and the demanded power of the auxiliary hydraulic pump 15. The limited recovery power signal 139A is output to the third division calculation part 132 and to the minimum value selection calculation section 108.

The calculation by the variable power limiting calculation section 139 will be described in detail with reference to FIG. 14. In FIG. 14, the horizontal axis indicates the target recovery power which is the recovery power signal 104A calculated by the first multiplication calculation part 104, and the vertical axis indicates the limited recovery power calculated by the variable power limiting calculation section 139. In FIG. 14, the characteristic line x indicated by the solid line determines the upper limit restriction line parallel to the horizontal axis by the maximum power of the electric motor 14. At this time, the demanded pump power signal 105A input from the second multiplication calculation part 105 is 0.

When the demanded pump power signal 105A input to the variable power limiting calculation section 139 increases from 0, the upper limit restriction line of the characteristic line x moves upwards in the y-direction by an amount corresponding to the increase. In other words, the variable power limiting calculation section 139 increases the upper limit of the limited recovery power by an amount corresponding to the input of the demanded pump power.

As a result, the upper limit of the target recovery power is raised, and the recovery power increases, achieving an improvement in terms of fuel efficiency. At the same time, even if energy in excess of the power of the electric motor 14 is input to the variable displacement hydraulic motor 62, it is used in the auxiliary hydraulic pump 15, whereby it is possible to prevent a power in excess of the specifications from entering the electric motor 14.

Here, the second function generator 102, the first subtraction calculation part 103, the first multiplication calculation part 104, the flow rate limiting calculation section 130, the variable power limiting calculation section 139, the third division calculation part 132, the third subtraction calculation part 133, the third function generator 134, the fixed revolution speed command section 136, and the fourth division calculation part 137 constitute a sixth calculation section configured to calculate the target opening area signal 134A which is a control command output to the solenoid proportional pressure reducing valve 60 controlling the opening degree of the control valve 61 so as to distribute the power discharged from the boom cylinder 3*a* to the discharge circuit such that the recovery power signal 104A does not exceed the recovery power signal 139A which is the sum total of the maximum power of the electric motor 14 and the demanded assist power.

In the hydraulic fluid energy regeneration apparatus of a work machine according to the fifth embodiment of the present invention described above, it is possible to achieve the same effect as that of the first embodiment.

Further, in the hydraulic fluid energy regeneration apparatus of a work machine according to the fifth embodiment of the present invention described above, the upper limit of the target recovery power is raised, the recovery power increases, and an improvement is achieved in terms of fuel efficiency. As a result, it is possible to prevent damage of the apparatus, and generation of overspeed, achieving an improvement in terms of reliability.

Embodiment 6

Figure 15:
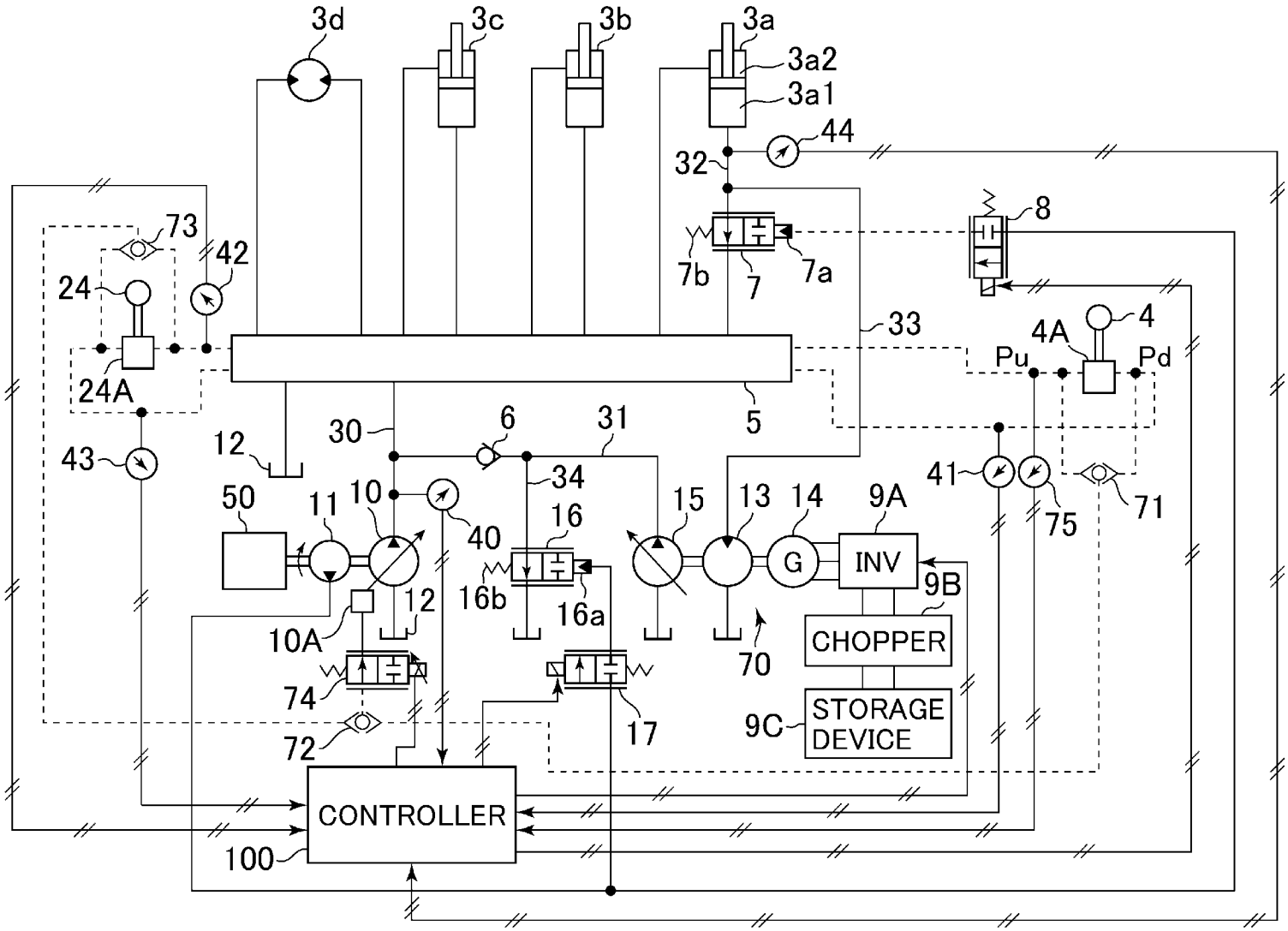
FIG. 15 is a schematic view of a drive control system, illustrating a hydraulic fluid energy regeneration apparatus of a work machine according to a sixth embodiment of the present invention.
Figure 16:
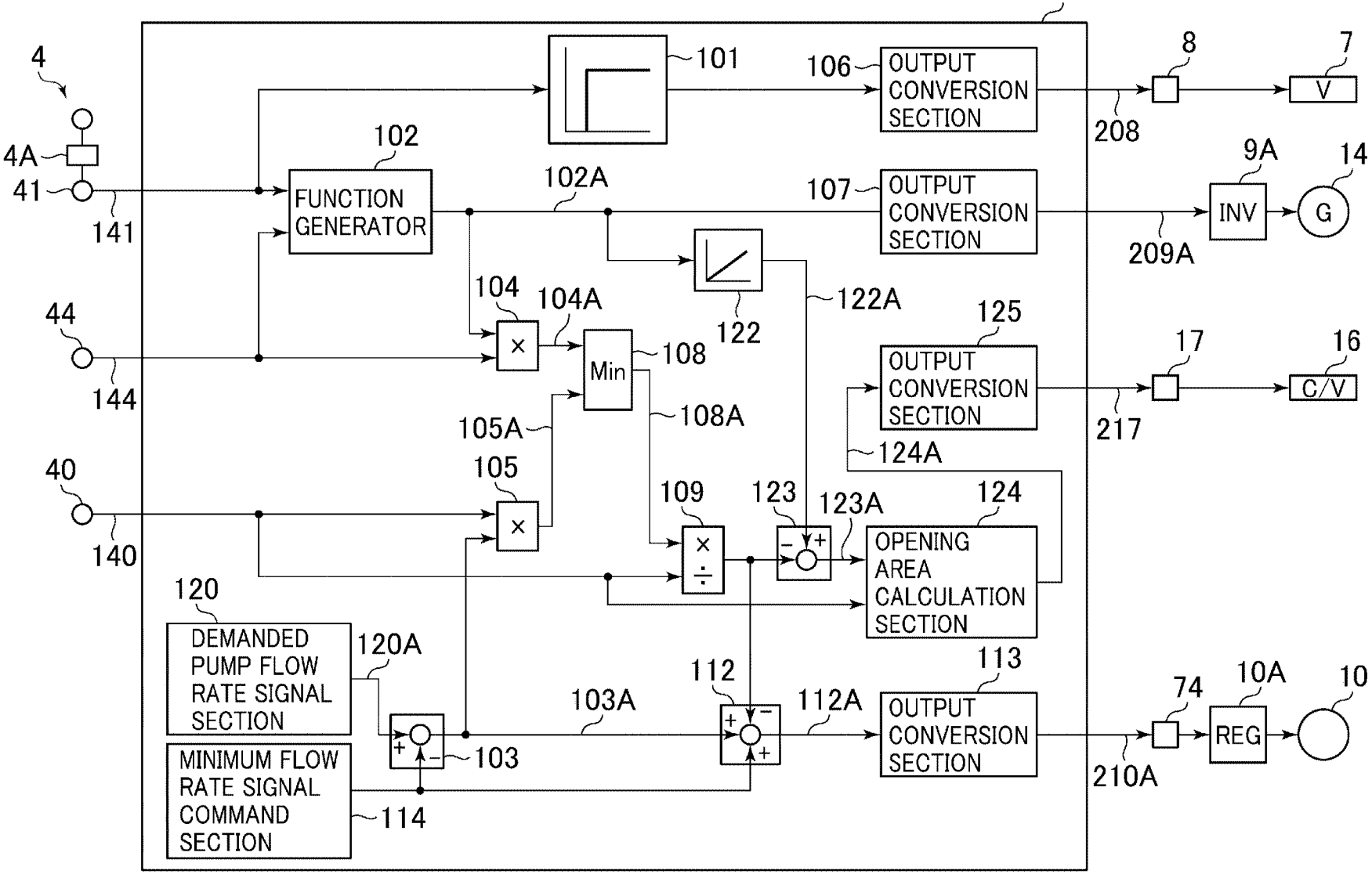
FIG. 16 is a block diagram of a controller constituting the hydraulic fluid energy regeneration apparatus of a work machine according to the sixth embodiment of the present invention.

In the following, a hydraulic fluid energy regeneration apparatus of a work machine according to a sixth embodiment of the present invention will be described with reference to the drawings. FIG. 15 is a schematic view of a drive control system, illustrating the hydraulic fluid energy regeneration apparatus of a work machine according to the sixth embodiment of the present invention, and FIG. 16 is a block diagram of a controller constituting the hydraulic fluid energy regeneration apparatus of a work machine according to the sixth embodiment of the present invention. In FIGS. 15 and 16, the same portions as those of FIGS. 1 through 14 are indicated by the same reference numerals, and a detailed description thereof will be left out.

The hydraulic fluid energy regeneration apparatus of a work machine according to the sixth embodiment of the present invention shown in FIGS. 15 and 16 are roughly composed of the same hydraulic fluid source, work machine, etc. as those of the first embodiment, and differs in the following construction. In the present embodiment, the flow rate control of the auxiliary hydraulic pump 15 supplying fluid to the hydraulic line 30 of the hydraulic pump 10 is performed not through the displacement control of the auxiliary hydraulic pump 15 but through the adjustment of the opening area of a bleed valve 16 provided in a discharge hydraulic line 34 as a discharge circuit connected to the auxiliary hydraulic line 31. Thus, the present embodiment also differs in that the auxiliary hydraulic pump 15 is formed by a fixed displacement hydraulic pump. Further, the controller 100 differs from that of the first embodiment in that it is provided with a fourth function generator 122, a fourth subtraction calculation part 123, an opening area calculation section 124, and a seventh output conversion section 125.

Referring to FIG. 15, the portions making the present embodiment different from the first embodiment will be described. To the portion of the auxiliary hydraulic line 31 between the auxiliary hydraulic pump 15 and the check valve 6, there is connected the discharge hydraulic line 34 that communicates with the tank 12. The discharge hydraulic line 34 is provided with the bleed valve 16 that controls the flow rate of the hydraulic fluid discharged from the auxiliary hydraulic line 31 to the tank 12.

The bleed valve 16 has a spring 16*b* on one end side, and a pilot pressure receiving portion 16*a* on the other end side. The spool of the bleed valve 16 moves in accordance with the pressure of the pilot hydraulic fluid input to the pilot pressure receiving portion 16*a*, so that the opening area allowing passage of the hydraulic fluid is controlled, and the valve is completely closed when the pressure of the pilot hydraulic fluid is of a certain fixed value or more. Due to this construction, it is possible to control the flow rate of the hydraulic fluid flowing through the discharge hydraulic line 34 to be discharged from the auxiliary hydraulic line 31 to the tank 12. To the pilot pressure receiving portion 16*a*, there is supplied the pilot hydraulic fluid from the pilot hydraulic pump 11 via a solenoid proportional pressure reducing valve 17 described below.

To the input port of the solenoid proportional pressure reducing valve 17 of the present embodiment, there is input the hydraulic fluid output from the pilot hydraulic pump 11. On the other hand, to the operation portion of the solenoid proportional pressure reducing valve 17, there is input a command signal output from the controller 100. In accordance with this command signal, the spool position of the solenoid proportional pressure reducing valve 17 is adjusted, whereby the pressure of the pilot hydraulic fluid supplied to the pilot pressure receiving portion 16*a* of the bleed valve 16 from the pilot hydraulic pump 11 is adjusted as appropriate.

In the present embodiment, the first adjuster making it possible to adjust the flow rate of the hydraulic fluid from the auxiliary hydraulic pump 15 flowing through the auxiliary hydraulic line 31 which is a confluence line is formed by the bleed valve 16 and the solenoid proportional pressure reducing valve 17 making it possible to adjust the opening area of the bleed valve 16.

The controller 100 outputs a control command to the solenoid proportional pressure reducing valve 17 such that a target discharge flow rate calculated in the controller is attained, and the difference between the delivery flow rate of the auxiliary hydraulic pump 15 and the target assist flow rate flows to the tank 12 via the bleed valve 16, thus adjusting the opening area of the bleed valve 16.

Next, an outline of the operation of the hydraulic fluid energy regeneration apparatus of a work machine according to the sixth embodiment of the preset invention will be described. The operation in the case where the operation lever of the operation device 4 is operated in the boom lowering direction so as not to exceed the prescribed value is the same as that of the first embodiment, so a description thereof will be left out.

When the operator operates the operation lever of the operation device 4 in the boom lowering direction at a level of the prescribed value or more, the controller 100 outputs a switching command to the solenoid selector valve 8, a revolution speed command to the inverter 9A, a control command to the solenoid proportional pressure reducing valve 17 controlling the bleed valve 16, and a control signal to the solenoid proportional valve 74.

As a result, the selector valve 7 is switched to the interrupting position, and since the hydraulic line to the control valve 5 is interrupted, the return hydraulic fluid from the bottom side hydraulic chamber 3*a*1 of the boom cylinder 3*a* flows to the regeneration circuit 33, and drives the hydraulic motor 13 before being discharged to the tank 12.

The auxiliary hydraulic pump 15 rotates due to the drive force of the hydraulic motor 13. The hydraulic fluid delivered from the auxiliary hydraulic pump 15 joins the hydraulic fluid delivered from the hydraulic pump 10 via the auxiliary hydraulic line 31 and the check valve 6, and operates so as to assist the power of the hydraulic pump 10.

The controller 100 outputs a control command to the solenoid proportional pressure reducing valve 17, and controls the opening area of the bleed valve 16, thereby adjusting the flow rate of the hydraulic fluid from the auxiliary hydraulic pump 15 joining the hydraulic pump 10. Through this operation, the flow rate of the hydraulic fluid joining the hydraulic pump 10 is controlled to a desired flow rate. Further, the controller 100 outputs a control signal to the solenoid proportional valve 74 so as to reduce the displacement of the hydraulic pump 10 by an amount corresponding to the flow rate of the hydraulic fluid supplied from the auxiliary hydraulic pump 15.

Of the hydraulic energy input the hydraulic motor 13, the surplus energy that cannot be consumed by the auxiliary hydraulic pump 15 is consumed by driving the electric motor 14 and generating electric power. The electrical energy generated by the electric motor 14 is stored in the storage device 9C.

In the present embodiment, the energy of the hydraulic fluid discharged from the boom cylinder 3*a* is recovered by the hydraulic motor 13, and assists the power of the hydraulic pump 10 as the drive force of the auxiliary hydraulic pump 15. Further, the surplus power is stored in the storage device 9C via the electric motor 14. Due to this arrangement, the energy is utilized effectively, and the fuel consumption is reduced. Further, since the adjustment of the confluence flow rate is performed through the adjustment of the opening area of the bleed valve 16, the auxiliary hydraulic pump 15 may be a fixed displacement hydraulic pump. As a result, the construction of the power regeneration device 70 is simplified.

Next, an outline of the control of the controller 100 of the present embodiment will be described with reference to FIG. 16. Referring to FIG. 16, the portions different from those of the first embodiment will be described.

In the first embodiment, the target displacement signal 110A calculated through the division of the target assist flow rate signal 109A by the final target bottom flow rate signal 102A is output to the regulator 15A from the third output conversion section 111, whereas, in the present embodiment, a target opening area signal 124A from the opening area calculation section 124 is output to a seventh output conversion section 125, and the seventh output conversion section 125 converts the input target opening area signal 124A to a control command of the solenoid proportional pressure reducing valve 17 and outputs it to the solenoid proportional pressure reducing valve 17 as a solenoid valve command 217. Through the above operation, the opening degree of the bleed valve 16 is controlled, and the flow rate of the auxiliary hydraulic pump 15 discharged to the tank 12 side is controlled. As a result, the confluence flow rate at the hydraulic pump 10 of the hydraulic fluid delivered from the auxiliary hydraulic pump 15 is controlled to a desired flow rate.

In the controller 100 of the present embodiment, the second division calculation part 110 and the third conversion section 111 of the first embodiment are omitted, and, in addition to the remaining calculation parts, there are provided the fourth function generator 122, the fourth subtraction calculation part 123, the opening area calculation section 124, and the seventh output conversion section 125.

As shown in FIG. 16, the fourth function generator 122 inputs the final target bottom flow rate signal 102A calculated by the second function generator 102, and, based on the final bottom flow rate signal 102A, calculates a delivery flow rate signal 122A of the auxiliary hydraulic pump 15. The delivery flow rate signal 122A is output to the fourth subtraction calculation part 123.

The fourth subtraction calculation part 123 inputs the delivery flow rate signal 122A of the auxiliary hydraulic pump 15 from the fourth function generator 122, and the target assist flow rate signal 109A from the first division calculation part 109, calculates the deviation thereof as a target bleed flow rate signal 123A, and outputs it to one input end of the opening area calculation section 124.

The opening area calculation section 124 inputs the target bleed flow rate signal 123A from the fourth subtraction calculation part 123 to one input end, and inputs the delivery pressure of the hydraulic pump 10 detected by the pressure sensor 40 to the other input end as the pressure signal 140. From these input signals, there is calculated the target opening area of the bleed valve 16 based on the orifice formula, and the target opening are signal 124A is output to the seventh output conversion section 125.

Here, the target opening area $A_0$ of the bleed valve 16 is calculated from the following equation (3).

$$A_0=Q_0/C\sqrt{P_p} \tag{3}$$

where $Q_0$ is the target bleed flow rate, $P_p$ is the hydraulic pump pressure, and C is the flow rate coefficient.

The seventh output conversion section 125 converts the input target opening area signal 124A to a control command of the solenoid proportional pressure reducing valve 17 and outputs it to the solenoid proportional pressure reducing valve 17 as the solenoid valve command 217. Through this operation, the opening degree of the bleed valve 16 is controlled, and the flow rate of the auxiliary hydraulic pump 15 discharged to the tank 12 side is controlled.

Next, the operation by the control logic of the hydraulic fluid energy regeneration apparatus of a work machine according to the sixth embodiment of the present invention will be described with reference to FIGS. 15 and 16. The portions related to the calculation parts added to the first embodiment will be described.

In the controller 100, the final target bottom flow rate signal 102A calculated by the second function generator 102 is input to the fourth function generator 122, and the fourth function generator 122 calculates the delivery flow rate signal 122A of the auxiliary hydraulic pump 15.

The delivery flow rate signal 122A calculated by the fourth function generator 122 and the target assist flow rate signal 109A calculated by the first division calculation part 109 are input to the fourth subtraction calculation part 123, and the fourth subtraction calculation part 123 calculates the target bleed flow rate signal 123A. The target bleed flow rate signal 123A is input to the opening area calculation section 124.

The opening area calculation section 124 calculates the target opening area signal 124A of the bleed valve 16 from the input target bleed flow rate signal 123A and the pressure signal 140 of the hydraulic pump 10, and outputs it to the seventh output conversion section 125.

The seventh output conversion section 125 outputs a control command to the solenoid proportional pressure reducing valve 17 such that the calculated opening area of the bleed valve 16 is attained. Through this operation, the surplus flow rate of the hydraulic fluid delivered from the auxiliary hydraulic pump 15 is discharged to the tank 12 via the bleed valve 16. As a result, the confluence flow rate of the hydraulic fluid of the hydraulic pump 10 and the hydraulic fluid of the auxiliary hydraulic pump 15 is adjusted to a desired flow rate.

In the hydraulic fluid energy regeneration apparatus of a work machine according to the sixth embodiment of the present invention described above, it is possible to attain the same effect as that of the first embodiment.

Further, in the hydraulic fluid energy regeneration apparatus of a work machine according to the sixth embodiment of the present invention described above, the flow rate adjustment of the hydraulic fluid from the auxiliary hydraulic pump 15 assisting the power of the hydraulic pump 10 is effected through the adjustment of the opening area of the bleed valve 16. As a result, the construction of the power regeneration device 70 is simplified, and it is possible to achieve a reduction in production cost and an improvement in terms of maintenance property.

The present invention is not restricted to the above embodiments but includes various modifications. For example, the above embodiments have been described in detail for the purpose of facilitate the understanding of the present invention. They are not always restricted to the ones equipped with all the components mentioned above.

DESCRIPTION OF REFERENCE CHARACTERS

1: Hydraulic excavator
1*a*: Boom
3*a*: Boom cylinder
3*a*1: Bottom side hydraulic chamber
3*a*2: Rod side hydraulic chamber
4: Operation device (first operation device)
4A: Pilot valve

5: Control valve
6: Check valve
7: Selector valve
8: Solenoid selector valve
9A: Inverter
9B: Chopper
9C: Storage device
10: Hydraulic pump
10A: Regulator
11: Pilot hydraulic pump
12: Tank
13: Hydraulic motor
14: Electric motor
15: Auxiliary hydraulic pump
15A: Regulator
16: Bleed valve
17: Solenoid proportional pressure reducing valve
24: Operation device (second operation device)
24A: Pilot valve
25: Chopper
30: Hydraulic line
31: Auxiliary hydraulic line
32: Bottom side hydraulic line
33: Regeneration circuit
34: Discharge hydraulic line
40: Pressure sensor
41: Pressure sensor (first operation amount sensor)
42: Pressure sensor (second operation amount sensor)
43: Pressure sensor (second operation amount sensor)
44: Pressure sensor
50: Engine
60: Solenoid proportional pressure reducing valve
61: Control valve
62: Variable displacement hydraulic motor
62A: Motor regulator
70: Power regeneration device
71: First high pressure selection valve
72: Third high pressure selection valve
73: Second high pressure selection valve
74: Solenoid proportional valve
75: Pressure sensor (first operation amount sensor)
76: Revolution speed sensor
77: Pressure sensor
100: Controller (control device)

The invention claimed is:

1. A hydraulic fluid energy regeneration apparatus of a work machine comprising:

a first hydraulic actuator;

a second hydraulic actuator;

a first operation device for operating the first hydraulic actuator;

a second operation device for operating the second hydraulic actuator;

a regeneration hydraulic motor driven by a return hydraulic fluid discharged from the first hydraulic actuator;

a first hydraulic pump mechanically connected to the regeneration hydraulic motor;

a second hydraulic pump that delivers a hydraulic fluid for driving at least one of the first hydraulic actuator and the second hydraulic actuator;

a confluence line that causes the hydraulic fluid delivered from the first hydraulic pump to join the hydraulic fluid delivered from the second hydraulic pump;

a first adjuster configured to adjust a flow rate of the hydraulic fluid from the first hydraulic pump flowing through the confluence line;

a second adjuster configured to adjust a delivery flow rate of the second hydraulic pump; and a control device configured to output respective control commands to the first adjuster and the second adjuster, wherein the control device includes a first calculation section configured to:

calculate, based on an operation amount of the first operation device and an operation amount of the second operation device, a non-confluence time pump flow rate in a case where there is no confluence of the hydraulic fluid delivered from the first hydraulic pump and where at least one of the first hydraulic actuator and the second hydraulic actuator is driven solely by the second hydraulic pump and calculate a demanded pump power of the first hydraulic pump such that the flow rate of the hydraulic fluid from the first hydraulic pump flowing through the confluence line is lower than the non-confluence time pump flow rate;

calculate a recovery power input to the regeneration hydraulic motor on the basis of the return hydraulic fluid discharged from the first hydraulic actuator in accordance with the operation amount of the first operation device; and set a target assist power so as not to exceed the recovery power and the demanded pump power and calculate a target assist rate from the target assist power; and calculate a control command output to the first adjuster such that the target assist rate is attained, and a second calculation section configured to calculate a target pump flow rate by subtracting the target assist flow rate from the non-confluence time pump flow rate and calculate a control command output to the second adjuster such that the target pump flow rate is attained.

2. The hydraulic fluid energy regeneration apparatus of a work machine according to claim 1, further comprising:

a first operation amount sensor that detects an operation amount of the first operation device; and a second operation amount sensor that detects an operation amount of the second operation device, wherein the control device takes in the operation amount of the first operation device detected by the first operation amount sensor and the operation amount of the second operation device detected by the second operation amount sensor, and the non-confluence time pump flow rate calculated by the control device is a demanded pump flow rate calculated from the operation amount of the first operation device and the operation amount of the second operation device.

3. The hydraulic fluid energy regeneration apparatus of a work machine according to claim 1, further comprising:

a first operation amount sensor that detects an operation amount of the first operation device;

a second operation amount sensor that detects an operation amount of the second operation device; and a revolution speed sensor that detects a revolution speed of the second hydraulic pump, wherein the control device takes in the operation amount of the first operation device detected by the first operation amount sensor, the operation amount of the second operation device detected by the second operation amount sensor, and the revolution speed of the second hydraulic pump detected by the revolution speed sensor, and the non-confluence time pump flow rate calculated by the control device is an estimated pump flow rate calculated from an estimated displacement of the second hydraulic pump estimated from the operation amount of the first operation device and the operation amount of the second operation device, and from the revolution speed of the second hydraulic pump.

4. The hydraulic fluid energy regeneration apparatus of a work machine according to claim 1, further comprising an revolution speed sensor that detects a revolution speed of the second hydraulic pump, wherein the second adjuster has a pump control signal unit configured to generate, based on an operation amount of the first operation device and an operation amount of the second operation device, a pump control signal for controlling a displacement of the second hydraulic pump, and a pump control signal correction unit configured to correct the pump control signal, the control device takes in the revolution speed of the second hydraulic pump detected by the revolution speed sensor, and the pump control signal, and the non-confluence time pump flow rate calculated by the control device is an estimated pump flow rate calculated from an estimated displacement of the second hydraulic pump estimated from the pump control signal, and from the revolution speed of the second hydraulic pump.

5. The hydraulic fluid energy regeneration apparatus of a work machine according to claim 1, further comprising:

an electric motor mechanically connected to the first hydraulic pump and the regeneration hydraulic motor;

a third adjuster configured to adjust a revolution speed of the electric motor.

6. The hydraulic fluid energy regeneration apparatus of a work machine according to claim 1, further comprising:

a discharge circuit that branches off from a branching portion provided in a line connecting the first hydraulic actuator and the regeneration hydraulic motor and is configured to discharge the return hydraulic fluid from the first hydraulic actuator to a tank;

a selector valve that is provided in the discharge circuit and switches the discharge circuit between communication and interruption; and a first operation amount sensor that detects an operation amount of the first operation device, wherein the control device includes a fourth calculation section configured to take in the operation amount of the first operation device detected by the first operation amount sensor and calculate an interruption command output to the selector valve in accordance with the operation amount.

7. The hydraulic fluid energy regeneration apparatus of a work machine according to claim 5, further comprising:

a discharge circuit that branches off from a branching portion provided in a line connecting the first hydraulic actuator and the regeneration hydraulic motor and is configured to discharge the return hydraulic fluid from the first hydraulic actuator to a tank; and a flow rate adjustment device that is provided in the discharge circuit and adjusts the flow rate of the discharge circuit, wherein the control device includes a fifth calculation section configured to calculate a control command output to the flow rate adjustment device so as to distribute the power discharged from the first hydraulic actuator to the discharge circuit such that the recovery power does not exceed a maximum power of the electric motor.

8. The hydraulic fluid energy regeneration apparatus of a work machine according to claim 5, further comprising:

a discharge circuit that branches off from a branching portion provided in a line connecting the first hydraulic actuator and the regeneration hydraulic motor and is configured to discharge the return hydraulic fluid from the first hydraulic actuator to a tank; and a flow rate adjustment device that is provided in the discharge circuit and adjusts the flow rate of the discharge circuit, wherein the control device includes a sixth calculation section configured to calculate a control command output to the flow rate adjustment device so as to distribute the power discharged from the first hydraulic actuator to the discharge circuit such that the recovery power does not exceed a sum total of a maximum power of the electric motor and the demanded assist power.

9. The hydraulic fluid energy regeneration apparatus of a work machine according to claim 5, further comprising:

a discharge circuit that branches off from a branching portion provided in a line connecting the first hydraulic actuator and the regeneration hydraulic motor and is configured to discharge the return hydraulic fluid from the first hydraulic actuator to a tank; and a flow rate adjustment device that is provided in the discharge circuit and adjusts the flow rate of the discharge circuit, wherein the control device includes a seventh calculation section configured to calculate a control command output to the flow rate adjustment device so as to distribute the power discharged from the first hydraulic actuator to the discharge circuit such as not to exceed the maximum flow rate that can be input to the regeneration hydraulic motor.

10. The hydraulic fluid energy regeneration apparatus of a work machine according to claim 1, further comprising:

a discharge hydraulic line that branches off from the confluence hydraulic line and communicates with a tank; and a bleed valve that is provided in the discharge hydraulic line and bleeds off a portion or all of the hydraulic fluid from the first hydraulic pump to a tank, wherein the first adjuster is constituted by the bleed valve and a solenoid proportional pressure reducing valve that adjusts an opening area of the bleed valve.

11. The hydraulic fluid energy regeneration apparatus of a work machine according to claim 1, wherein the first hydraulic pump is a variable displacement hydraulic pump, and the first adjuster is a regulator that controls the displacement of the variable displacement hydraulic pump.

* * * * *